US012714167B2

(12) United States Patent
Isaac et al.

(10) Patent No.: US 12,714,167 B2
(45) Date of Patent: Aug. 25, 2026

(54) BARRIER SLEEVE USABLE WITH MEDICAL GOWN AND METHODS OF USE THEREOF

(71) Applicant: Allegiance Corporation, Waukegan, IL (US)

(72) Inventors: Walter H. Isaac, Brimfield, MA (US); Joseph Palomo, Fox Lake, IL (US); James Vinson, Wadsworth, IL (US); Eric Euteneuer, Saint Michael, MN (US); Juan Azofeifa Viquez, Waukegan, IL (US); Sherril Vishaway, Southhampton, MA (US); Joe Miller, El Paso, TX (US); Armando Quinonez, El Paso, TX (US); Tina Keller, Fredericksburg, VA (US); Kathryn Murphy, Sammamish, WA (US); Oscar Silva Rodriguez, El Paso, TX (US)

(73) Assignee: ALLEGIANCE CORPORATION

( * ) Notice: Subject to any disclaimer, the term of this patent is extended or adjusted under 35 U.S.C. 154(b) by 0 days.

(21) Appl. No.: 18/330,066

(22) Filed: Jun. 6, 2023

(65) Prior Publication Data

US 2023/0397679 A1 Dec. 14, 2023

Related U.S. Application Data

(60) Provisional application No. 63/350,281, filed on Jun. 8, 2022.

(51) Int. Cl.
*A41D 13/12* (2006.01)

(52) U.S. Cl.
CPC ..... *A41D 13/1227* (2013.01)

(58) Field of Classification Search
CPC ..... A41D 13/1227; A41D 19/0089; A41D 13/1209; A41D 3/02
USPC ..... 2/114
See application file for complete search history.

(56) References Cited

U.S. PATENT DOCUMENTS 54,585 A * 5/1866 O'Neill ..... A41D 27/10 2/270
1,011,339 A * 12/1911 Golick ..... A41D 1/02 2/93
3,099,015 A * 7/1963 Renehan ..... B25J 21/02 285/260
4,389,734 A * 6/1983 Franz ..... A41D 13/1227 2/60

(Continued)

FOREIGN PATENT DOCUMENTS

CA 3045064 A1 12/2020

*Primary Examiner* — Tajash D Patel
(74) *Attorney, Agent, or Firm* — Cardinal Health and Arent Fox LLP

(57) ABSTRACT

A barrier sleeve usable with a protective gown, the barrier sleeve having a tubular cuff section including a cuff material and having a cuff section first end and a cuff section second end, and a tubular gasket section having a gasket material, the gasket section having a gasket section first end at the cuff section second end and a gasket section second end, the gasket material also including a gathered material and/or an extensible material, and the gasket material having a first thickness and able to exhibit a change in thickness upon compression of at least about 40%. Also disclosed are systems having the barrier sleeve, methods of making, and methods of using.

16 Claims, 18 Drawing Sheets

(56) References Cited

U.S. PATENT DOCUMENTS

| | | | | |
|---|---|---|---|---|
| 4,733,412 | A * | 3/1988 | Campbell | A41D 19/01529 2/164 |
| 4,977,011 | A | 12/1990 | Smith | |
| 5,208,919 | A * | 5/1993 | Fields | A41D 27/10 2/81 |
| 5,628,067 | A * | 5/1997 | Meyer | A41D 13/1227 2/125 |
| 7,302,711 | B1 * | 12/2007 | Tanenbaum | A41D 19/0089 2/161.7 |
| 2018/0092412 | A1 | 4/2018 | Genender et al. | |
| 2020/0329793 | A1 * | 10/2020 | Howell | A41D 13/1227 |

* cited by examiner

BARRIER SLEEVE USABLE WITH MEDICAL GOWN AND METHODS OF USE THEREOF

CROSS-REFERENCE TO RELATED APPLICATION

This application claims priority to U.S. Provisional Application No. 63/350,281, filed on Jun. 8, 2022, the content of which is incorporated herein in its entirety.

TECHNICAL FIELD

The present disclosure is directed to barrier sleeves usable with medical gowns and medical gloves.

BACKGROUND

In medical settings, the interface between gloves and gowns is one of the most troubling areas identified by medical professionals due to the frequency of fluid penetration of the interface.

There are several known causes of fluid penetration (i.e., leakage) at the glove/gown interface (i.e., fluid enters between the inner surface of the glove and the outer surface of the gown), which are often additive. First, hospitals and other medical settings often utilize oversized gowns in order to limit the number of gown sizes required (and thus, reduce inventory costs). However, the excess material at the sleeve of the gowns can cause glove beads to roll down, creating a breach in the glove/gown interface. In addition, gloves have a tendency to slip due to the low frictional interface between the inner surface of the glove and the outer surface of the gown. In addition, the excess material at the sleeve portion of conventional medical gowns can fold to create longitudinal channels in the gown sleeve between the inner surface of the glove and the outer surface of the gown. These channels can allow the passage of fluid between the outside environment and the wearer.

Another potential cause of fluid penetration is the sizing of surgical gloves, which are generally sized for the hand but are often too big in the forearm and wrist area. When a glove does not fit closely to the wrist and forearm of a user, fluid can leak under the glove bead and down through the wrist area. In addition, excess glove material at the forearm portion and/or glove bead provides a greater risk for glove roll-down and slippage, thus exposing the gown cuff to fluid. There are also instances where the surgical glove fits the hand but the glove bead is too tight on the forearm. In this case, the glove bead can roll down, exposing the cuff which has no barrier to liquids Previous attempts at solving the problem of fluid penetration of the glove/gown interface have been insufficient. For example, some existing proposed solutions attempt to eliminate only a portion of the causes of fluid leakage, such as glove rolling or slippage, without adequately addressing, for example, longitudinal channeling of the gown sleeve material. In another example, it has been proposed to add a cuff to existing medical gown sleeves such that the cuff can be folded over the bead of a glove. However, this alternative requires additional steps in the medical gown and glove donning and doffing processes, which can be prohibitive for medical professionals who are trained in conventional donning and doffing processes which do not comprise such additional steps of adding cuffs and removing cuffs.

There is thus a need in the art for medical gowns and systems that reduce or eliminate fluid leakage at the glove/gown interface.

SUMMARY

The present disclosure is directed to a barrier sleeve usable with a protective gown, the barrier sleeve comprising a tubular cuff section comprising a cuff material and having a cuff section first end and a cuff section second end, and a tubular gasket section comprising a gathered gasket material, wherein the gasket section has a gasket section first end at the cuff section second end and a gasket section second end, and wherein the gathered gasket material has a first thickness and is configured to exhibit a change in thickness upon compression of at least about 40%.

Also disclosed is a system comprising a protective gown having a body portion, a first sleeve portion, and a second sleeve portion, and a barrier sleeve attached to an inner surface of the first sleeve portion or the second sleeve portion, wherein the barrier sleeve comprises a tubular cuff section having a cuff section first end attached to the inner surface of the first sleeve portion or the second sleeve portion, and wherein the cuff section comprises a cuff material comprising at least two layers of a nonwoven material having one or more elastic strands therebetween.

Also disclosed is a method of making a barrier sleeve having a gasket section comprising providing a gasket section having a gathered gasket material, wherein the gathered gasket material is formed by providing one or more elastic strands in an elongated position, attaching the one or more elastic strands in the elongated position to one or more layers of a nonwoven material, and allowing the one or more elastic strands to retract such that the one or more layers of nonwoven material attached thereto are gathered.

The present disclosure is also directed to a medical glove usable with a protective gown as described herein. Methods of making and using the barrier sleeve, medical gown, and/or systems described herein are also included.

DETAILED DESCRIPTION

Figure 1:
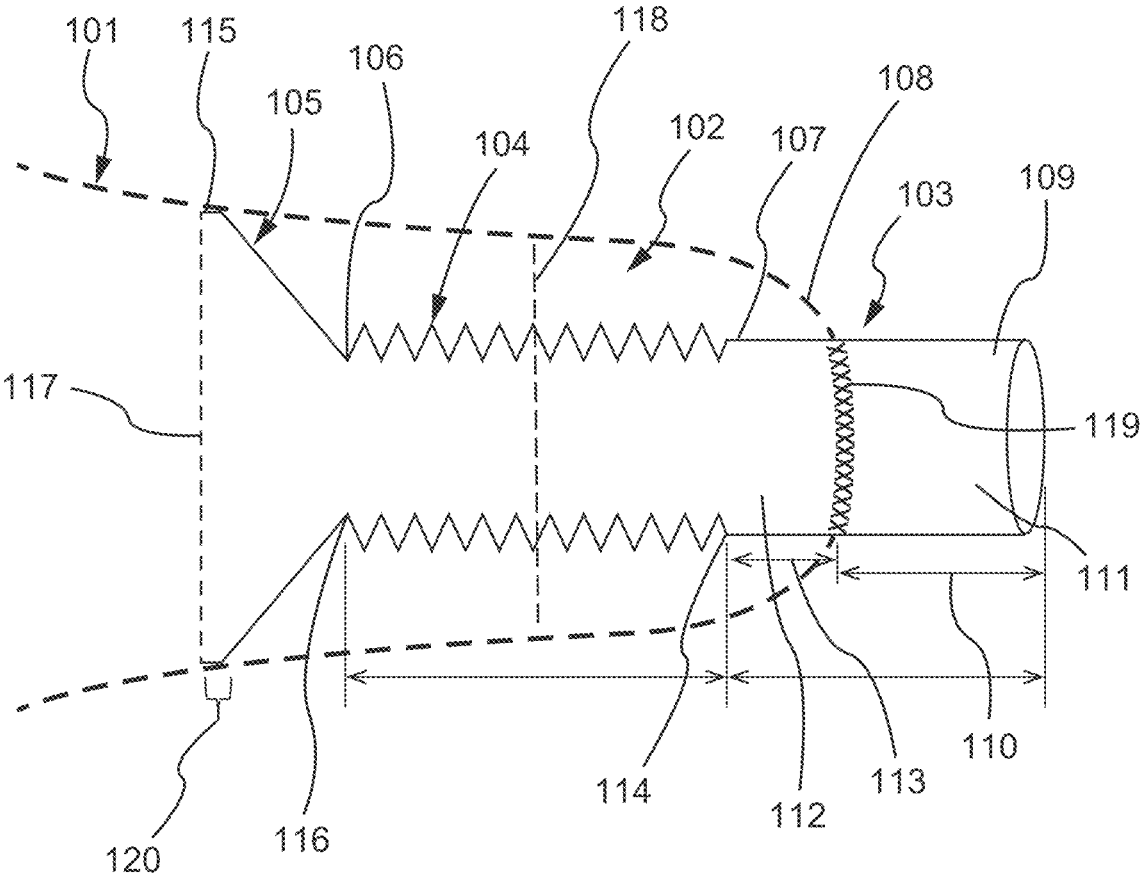
FIG. 1 shows a diagram view of an example barrier sleeve according to aspects of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details.

Throughout the disclosure, the terms substantially or approximately may be used as a modifier for a geometric relationship between elements or for the shape of an element or component. While the terms substantially or approximately are not limited to a specific variation and may cover any variation that is understood by one of ordinary skill in the art to be an acceptable variation, some examples are provided as follows. In one example, the term substantially or approximately may include a variation of less than 10% of the dimension of the object or component. In another example, the term substantially or approximately may include a variation of less than 5% of the object or component. In another example, the term substantially or approximately may include a variation of less than 3% of the object or component. If the term substantially or approximately is used to define the angular relationship of one element to another element, one non-limiting example of the term substantially or approximately may include a variation of 5 degrees or less. In another non-limiting example of the term substantially or approximately may include a variation of 3 degrees or less. These examples are not intended to be limiting and may be increased or decreased based on the understanding of acceptable limits to one of skill in the relevant art.

The word about is used herein to mean within ±5% of the stated value, optionally within ±4%, optionally within ±3%, optionally within ±2%, and optionally within ±1%.

For purposes of the disclosure, directional terms are expressed generally with relation to a standard frame of reference when the system and apparatus described herein is installed in an in-use orientation.

Terms such as a, an, and the are not intended to refer to only a singular entity, but include the general class of which a specific example may be used for illustration. The terms a, an, and the may be used interchangeably with the term at least one. The phrases at least one of and comprises at least one of followed by a list refers to any one of the items in the list and any combination of two or more items in the list. All numerical ranges are inclusive of their endpoints and non-integral values between the endpoints unless otherwise stated.

The terms first, second, third, and fourth, among other numeric values, may be used in this disclosure. It will be understood that, unless otherwise noted, those terms are used in their relative sense only. In particular, in some aspects certain components may be present in interchangeable and/or identical multiples (e.g., pairs). For these components, the designation of first, second, third, and/or fourth may be applied to the components merely as a matter of convenience in the description of one or more of the aspects of the disclosure.

For context, an overview is provided of aspects of the disclosure and the advantages the disclosure provides. This overview, and the detailed description that follows, has been presented for purposes of illustration and description. It is not intended to be exhaustive nor to limit the disclosure to the forms described. Numerous modifications are possible in light of the above teachings, including a combination of the abovementioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, may be employed in any number of applications and equivalent devices by those of ordinary skill in the art. Rather, it is hereby intended the scope be defined by the claims appended hereto.

The present disclosure is directed to a barrier sleeve usable with a medical gown, wherein the barrier sleeve is configured to provide reduced fluid transmission between a wearer and an outside environment. According to some aspects, the barrier sleeve comprises at least one of a cuff section, a gasket section, and a funnel section, wherein at least a portion of the barrier sleeve is configured to be wearable beneath a sleeve portion of a medical gown. The present disclosure is also directed to a medical gown having a barrier sleeve attached thereto and to a system comprising a barrier sleeve as described herein, a medical gown as described herein, and/or a medical glove usable with a medical gown as described herein. Methods of making and using the barrier sleeve, medical gown, and/or systems described herein are also included.

According to some aspects, the barrier sleeve includes a cuff section configured to be worn on a wearer's arm, particularly on a wearer's wrist and/or hand. The cuff section may include a cuff material. In some non-limiting aspects, the cuff material may include an extensible material. As used herein, an "extensible material" refers to a material having an elasticity sufficient for a structure formed from the material (e.g., a cuff section) to remain substantially in contact with a wearer when worn. In some non-limiting examples, the cuff material may include an extensible material such that the cuff section remains substantially in contact with a wearer's wrist and/or hand when worn. In particular, the cuff material may have an elasticity sufficient for the cuff section to remain in contact with a wearer's wrist and/or hand underneath a glove during use such that the transmission of fluid between a wearer and an environment outside of the cuff section is reduced or eliminated and/or such that displacement of the cuff section relative to a wearer's arm during use is reduced or eliminated.

Example cuff materials useful according to the present disclosure include, but are not limited to, one or more nonwoven materials, one or more woven materials (for example polyester), one or more knit fabrics, one or more elastic materials (for example spandex or rayon), one or more foams, or a combination thereof. Non-limiting examples of nonwoven materials include nonwoven materials comprising polyolefins such as polyethylene, polypropylene, blends thereof, and copolymers thereof. In some non-limiting examples, the nonwoven material comprises spunbond materials, meltblown materials, spunbond-meltblown-spunbond (SMS) laminate materials, or a combination thereof. As used herein, an "SMS laminate material" refers to a material having a first spunbond layer and a second spunbond layer having a meltblown layer therebetween. According to some aspects, the cuff material may comprise one or more layers of a spunbond material, one or more layers of a meltblown material, and/or one or more layers of an SMS laminate material as described herein.

Additionally or alternatively, the cuff material may comprise a laminate of a nonwoven material and an elastomeric film. Non-limiting examples of laminates useful according to the present disclosure include bilaminates (e.g., laminates of one layer of a nonwoven material and one layer of an elastomeric film), and trilamates (e.g., laminates of a layer of nonwoven material on both sides of an elastomeric film). In some examples, the elastomeric film may be elongated and the nonwoven material may be bonded to the elongated film, as will be described herein. Non-limiting elastomeric films useful according to the present disclosure include those described in U.S. Pat. No. 9,327,477, the contents of which are expressly incorporated herein in their entirety.

Additionally or alternatively, the cuff material may comprise woven materials, knitted materials, or a combination thereof. In some non-limiting examples, the cuff material may comprise a circular knitted material. As used herein, the term "circular knitting" refers to a form of weft knitting in which the knitting needles are organized into a circular knitting bed.

Additionally or alternatively, the cuff material may include a foam. Non-limiting examples of foams include silicone foams, urethane foams, and combinations thereof.

According to some aspects, the cuff material may comprise one, two, three, four, or more layers of a nonwoven material as described herein, wherein each layer comprises the same nonwoven material as or a different nonwoven material from another layer. According to some aspects, each of the nonwoven material layers may independently include an SMS laminate material or a spunbound material. According to some aspects, each layer of the nonwoven material may independently have a weight of between about 1 and 20 gsm, optionally between about 5 and 15 gsm, optionally between about 8 and 16 gsm, and optionally about 12 gsm. According to some aspects, each layer of the nonwoven material may independently have a weight of between about 1 and 20 gsm, optionally between about 10 and 50 gsm, optionally between about 20 and 50 gsm, optionally between about 20 and 25 gsm, optionally between about 25 and 30 gsm, optionally between about 30 and 35 gsm, optionally between about 35 and 40 gsm, optionally between about 40 and 45 gsm, optionally about 22 gsm, optionally about 34 gsm, and optionally about 44 gsm.

Additionally or alternatively, the cuff material may comprise one or more elastic strands. As used herein, a "strand" may refer to a material component having fibers or filaments twisted, plaited, and/or laid parallel to form a unit for further twisting and/or plaiting into yarn, thread, rope, and/or cordage. Example materials useful for the one or more elastic strands include, but are not limited to, elastic textile fibers comprising a polymer, such as a polyurethane and/or a poly(urethane-urea) polymer. According to some aspects, the one or more elastic strands may comprise spandex strands. Commercially available spandex strands include those referred to by the trade names Lycra, Creora, Roica, and Dorlastan. According to some aspects, the cuff material may comprise two or more layers of a nonwoven, woven, knitted, and/or elastic material as described herein with one or more elastic strands provided between two or more of the layers.

According to some aspects, the cuff material may comprise one or more elastic strands having a linear mass and/or percent elongation sufficient for the cuff section to function as described herein. For example, the one or more elastic strands may have a linear mass and/or percent elongation such that the cuff section has an elasticity sufficient for the cuff section to remain substantially in contact with a wearer's arm, wrist, and/or hand during use as described herein.

According to some aspects, the cuff material may have an elasticity sufficient for the cuff section to remain substantially in contact with a wearer's hand during glove donning and use, and in particular, to reduce or eliminate displacement (e.g., proximal displacement) of the cuff section relative to a wearer's hand during use.

In some non-limiting examples, the one or more elastic strands may have a linear mass of at least about 400 dtex, optionally at least about 500 dtex, optionally at least about 600 dtex, optionally at least about 700 dtex, optionally at least about 800 dtex, optionally at least about 900 dtex, optionally at least about 1000 dtex, and optionally at least about 1100 dtex. Additionally or alternatively, the one or more elastic strands may have a linear mass of between about 300 and 900 dtex, optionally between about 400 and 800 dtex, optionally between about 500 and 700 dtex, and optionally between about 540 and 680 dtex. In some non-limiting examples, the one or more elastic strands may have a percent elongation of between about 100% and 500%, optionally between about 200% and 400%, optionally between about 200% and 350%, and optionally about 300%.

According to some aspects, the cuff material may comprise one or more elastic strands being spaced such that the cuff section remains substantially in contact with a wearer's hand and/or wrist during use as described herein. For example, according to some aspects, a distance between at least a first elastic strand and a second elastic strand may be between about 1 and 15 mm, optionally between about 1 and 11.5 mm, and optionally between about 2 and 7.5 mm. According to some aspects, the cuff material may comprise between 1 and 40 elastic strands, optionally between about 10 and 30, and optionally about 20. According to some aspects, the cuff material may comprise 1 strand, optionally 2 strands, optionally 3 strands, optionally 4 strands, optionally 5 strands, optionally 6 strands, optionally 7 strands, optionally 8 strands, optionally 9 strands, optionally 10 strands, optionally 10 strands, optionally 11 strands, optionally 12 strands, optionally 13 strands, optionally 14 strands, optionally 15 strands, optionally 16 strands, optionally 17 strands, optionally 18 strands, optionally 19 strands, and optionally 20 strands.

According to some aspects, the cuff material may comprise one or more elastic strands wherein at least a portion of the elastic strands extend laterally or substantially laterally relative to the direction of the length of an appendage (e.g., an arm) when the cuff section is worn by a wearer.

According to some aspects, the cuff material may comprise one or more elastic strands that are about evenly spaced in the longitudinal direction of the length of an appendage when the cuff section is worn by a wearer. Alternatively, the cuff material may comprise one or more elastic strands that are unevenly spaced in the longitudinal direction of the length of an appendage when the cuff section is worn by a wearer. For example, the space between strands may decrease in a distal direction, i.e., in a direction away from the body of a wearer. That is, the strands may be closer together at a first or distal end of the cuff section than at a second or proximal end of the cuff section. In this way, pressure provided by the distal end of the cuff may be reduced. In some aspects, the one or more elastic strands may run parallel to or substantially parallel to one another. In some non-limiting examples, one or more portions of the cuff section may be free of strands.

According to some aspects, the cuff material may include a first portion of elastic strands that extend laterally or substantially laterally relative to the direction of the length of an appendage when the cuff section is worn by a wearer and a second portion of elastic strands that extend longitudinally or substantially longitudinally relative to the direction of the length of the appendage, thereby forming a web of elastic strands According to some aspects, the cuff material may comprise a "gathered" material. As used herein, the term "gathered" refers to a material that has been modified to increase the material's thickness when compared with the same material that has not been gathered. For example, a gathered material may be crinkled or ridged as compared with the same material that has not been gathered.

According to some aspects, a gathered material may formed by a process that includes one or more gathering steps. In one non-limiting example, the one or more gathering steps may include providing one or more elastic strands as described herein in an elongated position, attaching the one or more elastic strands to one or more layers of a nonwoven material, and allowing the one or more elastic strands to retract such that the one or more layers of nonwoven material attached thereto are gathered. Attaching the one or more elastic strands with the one or more layers of nonwoven material may be performed by any step suitable for gathering as described herein, including, but not limited to, via an adhesive (such as a hot melt adhesive), ultrasonic bonding, ultrasonic welding, sewing, and a combination thereof.

Additionally or alternatively, the one or more gathering steps may comprise providing an elastomeric film as described herein in an elongated position, attaching the elastomeric film to one or more layers of a nonwoven material, and allowing the elastomeric film to retract such that the one or more layers of nonwoven material attached thereto are gathered. In this example, the elastomeric film can be elongated in the machine direction, cross machine direction, or elongated in both the machine and cross machine directions.

Additionally or alternatively, the one or more gathering steps may comprise a dry mechanical compressive-treatment, such as a treatment performed by a microcreper system (e.g., the Micrex® process). In one non-limiting example, the one or more gathering steps may comprise creping one or more layers of a nonwoven material as described herein without requiring the use of an elastic material.

It should be understood that the one or more gathering steps as described herein may impart elasticity to a material. For example, a non-elastic nonwoven material as described herein may be gathered as described herein in order to provide an elastic material, that is, a material able to resume its normal shape after being stretched or compressed.

In some non-limiting examples, one or both ends of the cuff section may be folded over and secured, thus increasing the corresponding cuff edge's strength and durability. In some examples, at one or both ends of the cuff section, the one, two, three, four, or more layers of material as described herein may extend a certain distance past the last strand such that the layers of material may be folded over itself (i.e., the cuff section free of strands) and/or folded over all or a portion of the cuff section having the one or more strands. In some non-limiting examples, the certain distance is such that the cuff section free of strands may be folded over an entirety of the portion of the cuff section having the one or more strands. That is, the certain distance may be at least about the length of the portion of the cuff section having the one or more strands in the longitudinal direction of the length of the appendage. However, it should be understood that the present disclosure is not limited to this example. That is, one or both ends of the cuff section may both have strands and be folded over as described herein. According to some aspects, the folded over portion may have a length in the longitudinal direction of the length of the appendage that is between about 1 and 10 mm, optionally about 5 mm. According to some aspects, securing the folded over portion may include providing a permanent attachment. As used herein, the terms "permanently attached" and "permanent attachment" refers to an attachment that cannot be readily disconnected, for example, an attachment via an adhesive (such as a hot melt adhesive), stitching (including ultrasonic stitching), ultrasonic bonding, thermal bonding, tape, sealing (such as heat sealing), glue, and a combination thereof.

According to some aspects, the thickness of the cuff material may be selected in order to reduce inhibition of a wearer's movement by the cuff section at the wrist and/or hand proximal to the cuff section. As used herein, a material's thickness may refer to a distance between a first side thereof and a second side thereof, and may be measured using a device such as a caliper. According to some aspects, the cuff material may have a first thickness that is between about 1 and 10 mm, optionally between about 1 and 5 mm, optionally about 2.5 mm, and optionally no more than about 2.5 mm.

According to some aspects, the cuff section may define a generally tubular shape sufficient to fit on an arm, wrist, and/or hand of a wearer, as described herein. As used herein, the term "tubular" may refer to an elongated, enclosed, and hollow shape and is not necessarily limited to a particular cross-sectional shape. In some examples, a generally tubular shape may have a circular cross-sectional shape. In some examples, a generally tubular shape may have an ovular cross-sectional shape. According to some aspects, the generally tubular shape may be formed by attaching together two, three, four, or more sections of the cuff material as described herein along a length of the tubular shape in order to provide a tube. According to some aspect, the generally tubular shape may be formed by attaching together two sections of cuff material having about the same size along a length of the tubular shape via a permanent attachment as described herein. Additionally or alternatively, the cuff section may be formed by attaching together two, three, four, or more tubular sections of the cuff material as described herein along a circumference thereof in order to provide the cuff section. In some non-limiting examples, the two, three, four, or more tubular sections may be attached via a permanent attachment along the circumference(s) thereof.

According to some aspects, the cuff section may have a diameter of between about 1 and 10 inches, optionally between about 1 and 5 inches, optionally between about 2 and 4 inches, and optionally about 2.75 inches. As used herein, the term "diameter" may refer to the largest diameter of a tubular shape (e.g., the diameter with respect to a tubular component's outer surface). For purposes of this application, the conversion of 1 inch is 2.54 centimeters.

In some non-limiting examples, the cuff section may have a gathered circumference of between about 1 and 20 inches, optionally between about 2 and 14 inches, optionally between about 5 and 12 inches, and optionally between about 8 and 11 inches.

It should be understood that when a tubular component as described herein comprises an elastic material, the component's diameter and circumference may vary as the elastic material stretches. As used herein, measurements provided for a component's diameter and circumference may refer to the component's respective dimensions when the component is in an unstretched configuration.

According to some aspects, the cuff section may have a length relative to the length of a wearer's appendage that is between about 1 and 20 inches, optionally between about 1 and 15 inches, optionally between about 1 and 10 inches, optionally between about 2.5 and 7.5 inches, optionally about 5 inches, and optionally about 3 inches.

The barrier sleeve according to the present disclosure may further comprise a gasket section. The gasket section may be configured to be worn on a wearer's arm, particularly around a wearer's forearm. As used herein, a forearm extends from a wearer's wrist to just before a wearer's elbow.

According to some aspects, the gasket section may define a generally tubular shape sufficient to fit around an arm of a wearer, such as around a forearm of a wearer as described herein. The gasket section may have a length (e.g., a dimension in the direction of the length of a wearer's arm when worn) that is between about 1 and 20 inches, optionally between about 1 and 15 inches, optionally between about 1 and 10 inches, optionally between about 2 and 7.5 inches, and optionally about 5 inches.

According to some aspects, the gasket section may have a diameter of between about 1 and 10 inches, optionally between about 1 and 6 inches, optionally between about 1 and 5 inches, and optionally about 3.50 inches.

According to some aspects, the gasket section may have a gathered circumference of between about 3 and 25 inches, optionally between about 5 and 20 inches, optionally between about 7 and 18 inches, optionally between about 8 and 15 inches, and optionally between about 10 and 13 inches.

According to some aspects, the gasket section may have a first end and a second end, wherein the first end is attachable and/or attached to a second end of a cuff section as described herein. According to some aspects, a "first end" as described herein may be a distal end, that is, an end of a component that is furthest from the body of a wearer when the component is worn. A "second end" as described herein may be a proximal end, that is, an end of a component that is closest to the body of a wearer when the component is worn.

It should be understood that the term "attached" as used herein encompasses both reversible attachment and permanent attachment. As used herein, the term "reversibly attached" refers to an attachment that may be readily disconnected, for example, attachment via a fastener. Examples of fasteners include any fastener known in the art that are configured to reversibly connect two portions of a garment as described herein and are suitable for use in a medical setting. For example, the faster may be selected from the group consisting of a tie, snap, button, fabric hook and loop fastener, zipper, buckle, hook and eye, cord, toggle, brooch, eyelet, and/or a combination thereof. The term "permanently attached" has been described above.

According to some aspects, the gasket section and the cuff section may comprise a discrete material such that no attachment is necessarily required. For example, the gasket section and the cuff section may comprise one or more layers of material as described herein, wherein the one or more layers of material forms at least a portion of the cuff section and at least a portion of the gasket section.

According to some aspects, the gasket section may comprise a gasket material. In some non-limiting examples, the gasket material may include an extensible material such that the gasket section remains substantially in contact with a wearer's arm during use, and in particular, to reduce or eliminate displacement of the gasket section relative to a wearer's arm during use.

Example gasket materials useful according to the present disclosure include, but are not limited to, one or more nonwoven materials, one or more woven materials, one or more knit fabrics, one or more elastic materials, one or more foams, or a combination thereof, as described herein. According to some aspects, the gasket material may comprise one or more nonwoven materials and/or one or more elastomeric films as described herein. According to some aspects, the gasket material may comprise one or more layers of a spunbond material, a meltblown material, and/or an SMS laminate material as described herein.

According to some aspects, the gasket material may comprise one, two, three, four, or more layers of an elastic material as described herein, wherein each layer comprises the same material as or a different material from another layer. Each of the one, two, three, four, or more layers of elastic material may be attached to at least one other layer by any of the attachment mechanisms as described herein.

According to some aspects, the gasket material may comprise one, two, three, four, or more layers of a spunbond material, a meltblown material, and/or an SMS laminate material, wherein each of the layers is the same material as another layer or a different material from another layer. According to some aspects, the gasket material may comprise one, two, three, four, or more layers of an SMS laminate material, wherein each layer may independently have a weight of between about 1 and 50 gsm, optionally between about 1 and 40 gsm, optionally between about 10 and 30 gsm, optionally about 20 gsm, and optionally about 25 gsm.

According to some aspects, the gasket material may comprise one or more elastic strands as described herein. According to some aspects, the gasket material may comprise two or more layers as described herein with elastic strands provided between two or more of the layers. According to some aspects, the elastic strands may be attached to one or more of the layers by any process suitable according to the present disclosure as described herein.

According to some aspects, the gasket material may comprise one or more elastic strands having a linear mass and/or percent elongation such that the gasket section remains substantially in contact with a wearer's forearm during use as described herein. In some non-limiting examples, the one or more elastic strands may have a linear mass of at least about 400 dtex, optionally at least about 500 dtex, optionally at least about 600 dtex, optionally at least about 700 dtex, optionally at least about 800 dtex, optionally at least about 900 dtex, optionally at least about 1000 dtex, optionally at least about 1100 dtex, optionally at least about 1200 dtex, optionally at least about 1300 dtex, optionally at least about 1400 dtex, optionally at least about 1500 dtex, optionally at least about 1600 dtex, optionally at least about 1700 dtex, optionally at least about 1800 dtex, optionally at least about 1900 dtex, optionally at least about 2000 dtex. Additionally or alternatively, the one or more elastic strands may have a linear mass of between about 300 and 900 dtex, optionally between about 400 and 800 dtex, optionally between about 500 and 700 dtex, and optionally between about 540 and 680 dtex. Additionally or alternatively, the one or more elastic strands may have a linear mass of about 1100 dtex, or about 1520 dtex. In some non-limiting examples, the one or more elastic strands may have a percent elongation of between about 100% and 500%, optionally between about 200% and 400%, optionally between about 250% and 350%, optionally between about 275% and 350%, and optionally between about 275% and 325%.

According to some aspects, the gasket material may comprise one or more elastic strands being spaced such that the gasket section remains substantially in contact with a wearer's arm during use as described herein. For example, according to some aspects, a distance between at least a first elastic strand and a second elastic strand may be between about 0.1 and 5 inches, optionally between about 0.1 and 2 inches, and optionally about 1 inch. According to some aspects, a distance between at least a first elastic strand and a second elastic strand may be between about 3 and 100 mm, optionally between about 5 and 50 mm, and optionally about 25 mm.

According to some aspects, the gasket material may comprise one or more elastic strands wherein at least a portion of the elastic strands extends in a direction that is lateral in relation to the length of an appendage when the gasket section is worn by a wearer. In some non-limiting examples, the gasket material may comprise one or more elastic strands that are about evenly spaced in a direction that is lateral in relation to the length of an appendage when the gasket section is worn by a wearer. According to some aspects, the gasket material may comprise between 1 and 10 elastic strands, optionally between about 4 and 7, and optionally 5 or 6. According to some aspects, the gasket material may comprise 1 strand, optionally 2 strands, optionally 3 strands, optionally 4 strands, optionally 5 strands, optionally 6 strands, optionally 7 strands, optionally 8 strands, optionally 9 strands, and optionally 10 strands.

According to some aspects, the gasket material may include a first portion of elastic strands that extend laterally or substantially laterally relative to the direction of the length of an appendage when the gasket section is worn by a wearer and a second portion of elastic strands that extend longitudinally or substantially longitudinally relative to the direction of the length of the appendage, thereby forming a web of elastic strands According to some aspects, the gasket material may have a second thickness that is greater than the thickness of the cuff material. For example, the gasket material may have a thickness of between about 1 and 20 mm, optionally between about 5 and 15 mm, and optionally 7.5 mm to 12 mm. According to some aspects, the gasket material may have a second thickness that is greater than the thickness of the cuff material. For example, the gasket material may have a thickness of between about 1 and 10 mm, and optionally between about 1 and 5 mm. In some examples, the gasket material may have a thickness of at least about 4 mm, optionally of at least about 4.5 mm, optionally of at least about 5 mm, optionally of at least about 5.5 mm, optionally of at least about 6 mm, optionally of at least about 6.5 mm, optionally of at least about 7 mm, optionally at least about 7.5 mm, optionally at least about 8 mm, optionally at least about 8.5 mm, optionally at least about 9 mm, optionally at least about 9.5 mm, optionally at least about 10 mm, optionally at least about 10.5 mm, optionally at least about 11 mm, and optionally at least about 11.5 mm. According to some aspects, the gasket material is configured to be rolled into an elastic ring that is positioned on the forearm in a position that is distal a glove bead and proximal a wearer's wrist in order to create an additional thickness up to 25 mm.

According to some aspects, the gasket material may include a gathered material as described herein.

According to some aspects, the gasket material may be readily compressible. As used herein, the term "readily compressible" refers to a material configured to have a first thickness and a second thickness upon compression, wherein the second thickness is different from the first thickness. According to some aspects, compression may refer to the approximate compressive force provided by a glove bead when worn by a wearer.

According to some aspects, a readily compressible material may be a material exhibiting a certain change in thickness upon compression, that is, a certain difference between a first thickness and second thickness as described herein. In one non-limiting example, the change in thickness may be measured using a device such as a caliper. Non-limiting examples of calipers useful for measurements according to the present disclosure include an Ames Model AQD-2110N gauge using a 1-inch diameter foot. According to some aspects, a material's first thickness may be measured using a caliper with a first pressure applied thereto and its second thickness may be measured using a caliper having a second pressure applied thereto. According to some aspects, the first pressure may correspond with use of the caliper without an additional weight added thereto, and the second pressure may be provided by adding a weight added to the caliper. In some non-limiting examples, the weight may be between about 0.01 and 1 pound, optionally between about 0.25 and 0.75 pounds, and optionally about 0.5375 pounds. For purposes of this application, the conversion of 1 pound is 453.6 grams.

According to some aspects, a readily compressible material may be a material that exhibits a change in thickness upon compression as described herein of at least about 30%, optionally at least about 40%, optionally at least about 50%, optionally at least about 55%, optionally at least about 60%, optionally at least about 65%, optionally at least about 70%, and optionally at least about 75%. According to some aspects, a readily compressible material may be a material that exhibits a change in thickness upon compression of between about 20% and 90%, optionally between about 30% and 80%, and optionally between about 40% and 70%.

According to some aspects, the gathered material may exhibit a change in thickness when compressed by one or more glove beads such that a channel is formed in the gathered material proximal the one or more glove beads. For example, when a barrier sleeve having a gasket section as described herein extends from a first end to a second end along the longitudinal direction of the length of a wearer's arm when worn, and when a wearer dons one or more gloves over the barrier sleeve, the gathered material may be configured to compress proximal the glove bead(s) in order to form one or more channels that are substantially transverse (i.e., lateral) to the length dimension (e.g., along the circumference of a tubular gasket section). According to some aspects, the one or more channels may be sufficient to engage with the one or more glove bead such that penetration of fluids towards the cuff section is eliminated or reduced. Additionally or alternatively, the one or more channels may be sufficient to engage with the one or more glove bead such that roll-down of the one or more glove beads is eliminated.

According to some aspects, the barrier sleeve may further comprise a funnel section. The funnel section may be configured to be worn on a wearer's arm, such as around a wearer's forearm. The funnel section may have a first end and a second end, wherein the first end is attachable and/or attached to the second end of a gasket section as described herein.

According to some aspects, the funnel section may have a circumference and/or a diameter that is greater than a circumference and/or diameter of the gasket section. The funnel section may have an approximately constant circumference and/or diameter. Alternatively, the funnel section may have a varying circumference and/or diameter along a length thereof. For example, the funnel section may have a circumference and/or diameter at a first end that is approximately equal to the circumference and/or diameter of the second end of the gasket section. In this example, the circumference and/or diameter of the funnel section may increase along a length of the funnel section toward the second end to form a funnel shape.

According to some aspects, the funnel section may comprise a funnel material. Example funnel materials useful according to the present disclosure include, but are not limited to, nonwoven materials and elastic materials as described herein. For example, the funnel material may comprise one or more nonwoven materials as described herein, such as nonwoven materials comprising a polyolefin. According to some aspects, the funnel material may comprise one or more layers of a spunbond material, a meltblown material, and/or an SMS laminate material as described herein. According to some aspects, the funnel material may comprise one, two, three, four, or more layers of a material as described herein, wherein each layer comprises the same material as or a different material from another layer. Additionally or alternatively, the funnel material may comprise one or more elastic strands as described herein.

According to some aspects, the funnel section may be attachable and/or attached to the gasket section by any mechanism as described herein. Alternatively, the funnel section and the gasket section may comprise a discrete material such that no attachment mechanism is necessarily required. For example, the funnel section and the gasket section may comprise one or more layers of a material as described herein, wherein the one or more layers forms at least a portion of the funnel section and at least a portion of the gasket section. In one non-limiting example, the funnel section and the gasket section may comprise one or more layers of an SMS laminate material as described herein. In this example, the gasket section may comprise one or more elastic strands as described herein in order to provide a gathered gasket material. The funnel section may also comprise elastic strands or it may be free of elastic strands such that the funnel material is not gathered.

According to some aspects, the barrier sleeve as described herein is usable with a corresponding sleeve portion of a gown. According to some aspects, the gown is a protective gown, also referred to as a medical gown. As used herein, the term "medical gown," refers to a gown useable in a medical environment. Examples of medical gowns according to the present disclosure include, but are not limited to, surgical gowns, isolation gowns, and non-surgical gowns, including those used in in the central sterile department of hospitals where used re-useable surgical instruments are manually decontaminated at a sink prior to entering an automate washing machine, and those used in hazardous chemical environments with high fluid exposure risk. Example medical environments include, but are not limited to, hospitals, medical offices, blood banks, hospices, imaging and radiology centers, nursing homes, rehabilitation centers, and urgent care centers. According to some aspects, the gown is an industrial gown. As used herein, the term "industrial gown" refers to a gown used in a potentially hazardous industrial environment, such an industrial environment wherein one may be exposed to hazardous chemicals.

According to some aspects, a medical gown as described herein meets required performance standards as outlined in ASTM F2407 Standard Specification for Surgical Gowns Intended for Use in Healthcare Facilities. for medical gowns, including but not limited to performance standards for tensile strength (e.g., ASTM D5034, ASTM D1682), tear resistance (e.g., ASTM D5587 (woven), ASTM D5733 (nonwoven), ASTM D1424), seam strength (e.g., ASTM D751 (stretch woven or knit)) and ASTM D1683/D1683M for woven and nonwoven materials, lint generation (e.g., ISO 9073 Part 10), abrasion resistance ASTM D4966, water vapor transmission (e.g., ASTM F1868 Part B, ASTM D6701 (nonwoven), ASTM D737-75, ASTM E96/E96M, ASTM F1249), or a combination thereof. Additionally or alternatively, the medical gown may meet the requirements of Level 1, Level 2, Level 3, or Level 4 of ANSI/AAMI PB 70. In one non-limiting example, the medical gown may meet Level 4 requirements of ANSI/AAMI PB 70 (i.e., ASTM F1670 and ASTM F1671). Additionally or alternatively, the medical gown may meet one or more requirements for viral penetration as specified by ASTM F1671. It should be understood that all performance requirements referenced herein are incorporated by reference in their entity.

According to some aspects, at least a portion of the protective gown may include a gown material having a low basis weight. For example, one or more of the sleeve portions may include a gown material having a low basis weight sufficient for providing acceptability drapability, that is, the ability to conform to the shape of a surface. As used herein, an "acceptable drapability" may refer to a drapability sufficient to provide one or more functions as described herein, such as providing one or more lateral channels at and around a glove/gown interface, as will be described in relation to the barrier sleeve. It should be understood that a gown material having lower basis weight and/or higher drapability may more easily form channels than, for example, a stiffer and/or less drape-able gown material.

Non-limiting examples of gown materials useful according to the present disclosure include laminates having discontinuous bonding. As used herein, a laminate having "discontinuous bonding" refers to a laminate wherein less than 100% of the surface area of the laminated layers is bonded. For example, a laminate having discontinuous bonding may include two or more layers bonded via a thermal patterned calendar bond, a patterned hot melt spray, or a combination thereof. According to some aspects, the laminate may include one or more layers of a monolithic film, a nonwoven material, or a combination thereof.

In some non-limiting examples, the gown material may have a basis weight of between about 25 and 90 gsm, optionally between about 30 and 85 gsm, optionally between about 34 and 75 gsm, including any value therebetween.

A medical gown according to the present disclosure may be a single-use gown or a multi-use gown. In some non-limiting examples, the multi-use gown may comprise a woven material sufficient to be laundered as known in the art.

In some aspects, the barrier sleeve is usable with a protective gown that may be used in any scenario where a wearer of the gown is to be protected from an external environment or contaminants associated therewith, and/or where an external environment is to be protected from contaminants that the wearer may introduce into the external environment.

According to some aspects, at least a portion of the barrier sleeve is configured to be wearable by a user beneath a sleeve portion of a medical gown. As used herein, the term "beneath" refers to a location proximal a wearer's arm. In one example of the aforementioned sealing interaction (also referred to as a sealing engagement), an elastic glove bead engages (e.g., may be retained or otherwise captively held within) a lateral channel formed in the gasket section via compression thereof, as described herein. The engaging interaction does not require that the glove bead directly contact the gasket section (e.g., the sleeve portion of a medical gown may be sandwiched therebetween). The engaging interaction may provide a sealing interaction with an additional one or more layers between the channel of the gasket section and the glove bead, such that penetration of fluids towards the cuff section is eliminated or reduced.

In one preferred example, the gasket section may worn by a user underneath a gown sleeve, and an elastic glove bead may be retainably held within one or more channels formed in the gasket section as described herein, with a portion of the gown sleeve also being retainably held between the glove bead and the gasket section. Thus, in the aforementioned example, the gasket section provides a seal or partial seal between the glove bead and the gown sleeve such that penetration of fluids towards the cuff section is reduced and/or eliminated. In some examples wherein fluid may penetrate the glove bead(s), the gasket section may substantially or completely fill the space in the forearm area sufficient to reduce the flow of the fluid between the glove and the gown down the forearm toward a wearer's hand.

Additionally or alternatively, the barrier sleeve may be configured such that, if fluid penetrates beyond the gasket section as described herein, the cuff section may protect the hand from fluid exposure.

FIG. 1 shows an example sleeve portion 101 of a medical gown as described herein. The sleeve portion 101 may have a first circumference 117 as known in the art. For example, the sleeve portion 101 may have a relatively large first circumference 117 such that the sleeve portion 101 is relatively oversized in relation to a wearer's arm (i.e., is not sized to remain in contact with a wearer's arm during use). In some non-limiting examples, the sleeve portion of a medical gown may have a first circumference that is between about 10 and 20 inches, optionally between about 15 and 21 inches, and optionally between about 16 and 18 inches measured 9 inches from the end of the gown sleeve.

As shown in FIG. 1, sleeve portion 101 may have a varied circumference along its length. For example, sleeve portion 101 may have a first circumference 117 as described herein approximately proximal a funnel section 105 as described herein. It should be understood that first circumference 117 may be slightly smaller than a circumference of funnel section 105 at a second end 115 such that when funnel section 105 and sleeve portion 101 are attached to each other, funnel section 105 does not unacceptably pull at sleeve portion 101 when worn.

Additionally or alternatively, it may have a second circumference 118 and/or a third circumference 119 that are different from first circumference 117. In this example, second circumference 118 may be approximately proximal a gasket section 104 as described herein, and third circumference 119 may be approximately proximal a cuff section 103 as described herein. Second circumference 118 may be between about 10 and 20 inches, optionally between about 10 and 15 inches, and optionally between about 12 and 14 inches. Third circumference 119 may be between about 5 and 20 inches, optionally between about 10 and 15 inches, and optionally between about 11 inches.

FIG. 1 also shows an example barrier sleeve 102 having a cuff section 103, a gasket section 104, and a funnel section 105 as described herein. As shown in FIG. 1, barrier sleeve 102 may be reversibly or permanently attached to sleeve portion 101. For example, funnel section 105 may have a second end 115 that is directly or indirectly attachable and/or attached to an inside surface of sleeve portion 101 as shown in FIG. 1. According to some aspects, sleeve portion 101 may be free of structural attachment components, that is, free of structural components provided to facilitate attachment of barrier sleeve 102 thereto. Structural attachments may include, for example, flaps, tabs, and/or other appendages that would not be provided on a sleeve portion without barrier sleeve 102.

According to some aspects, second end 115 of funnel section 105 may be attached to an inside surface of sleeve portion 101 via a permanent attachment as described herein. In some non-limiting examples, the permanent attachment may include hotmelt. In this example, a portion 120 of funnel section 105 having a certain length in the longitudinal direction may be attached to an inside surface of sleeve portion 101 by applying a hotmelt spray onto the portion 120 of funnel section 105. According to some aspects, the length of portion 120 may be between about 0.1 and 1 inch, optionally between about 0.25 and 0.75 inches, and optionally about 0.5 inches. Additionally or alternatively, hotmelt spray may be applied to a corresponding portion of the inside surface of sleeve portion 101, and the two portions may be pressed together to form a permanent attachment. However, it should be understood that the disclosure is not necessarily limited in this way. For example, the portion 120 of funnel section 105 and the corresponding portion of the inside surface of sleeve portion 101 may be attached via any permanent attachment as described herein, including thermal bonding, ultrasonic boding, or a combination thereof.

In one non-limiting example, portion 120 of funnel section 105 may be attached to an inside surface of sleeve portion 101 by first providing sleeve portion 101 inside-out over a support such that the inside surface of sleeve portion 101 is exposed. Then, funnel section 105 may be provided on the sleeve portion 101 and at least a portion 120 of funnel section 105 may be folded and/or rolled over. A hotmelt spray may then be applied to inside surface of sleeve portion 101 and/or the folded and/or rolled portion 120 of funnel section 105, optionally with rotation of the support. The folded and/or rolled portion 120 of funnel section 105 may then be unfolded and/or unrolled such that it contacts the inside surface of sleeve portion 101, and the portion 120 of funnel section 105 and inside surface of sleeve portion 101 may then be pressed together in order to provide a permanent attachment.

In another non-limiting example, the portion 120 of funnel section 105 and inside surface of sleeve portion 101 may be attached via ultrasonic bonding in order to provide a permanent attachment with properties of a single nonwoven layer.

As shown in FIG. 1, at least a portion of barrier sleeve 102 may not be attachable and/or attached to sleeve portion 101. For example, a second end 106 of gasket section 104 may be provided at a first end 116 of funnel section 105, wherein gasket section 104 is not otherwise connected to sleeve portion 101. Further, as shown in FIG. 1, gasket section 104 may have a second circumference and/or second diameter as described herein, wherein the second circumference and/or second diameter is less than the second circumference 118 of sleeve portion 101. In this way, sleeve portion 101 may be free to move in relation to gasket section 104, and vice versa.

As shown in FIG. 1, gasket section 104 may have a first end 107 at a second end of cuff section 103 as described herein. In this example, cuff section 103 may be attachable and/or attached to sleeve portion 101. For example, as shown in FIG. 1, cuff section 103 may be attachable and/or attached to an inside edge surface 108 of sleeve portion 101 by any attachment mechanism as described herein. According to some aspects, cuff section is attachable and/or attached to an inside edge surface of sleeve portion sufficient to avoid holes in the sleeve portion and/or cuff portion, thus retaining a medical gown's barrier properties.

It should be understood that cuff section 103 may be attachable and/or attached to sleeve portion 101 at any location of cuff section 103. For example, as shown in FIG. 1, cuff section 103 may be attachable and/or attached to sleeve portion 101 at a first distance 110 from a first end 109 of cuff section 103. It should be understood that first distance 110 is not particularly limited. In some non-limiting examples, first distance 110 may be between about 1 and 10 inches, optionally between about 1 and 5 inches, and optionally about 3 inches.

As shown in FIG. 1, if cuff section 103 is attachable and/or attached to an inside edge surface 108 of sleeve portion 101 a first distance 110 from the first end 109 of cuff section 103, cuff section 103 will comprise an exposed portion 111 and an unexposed portion 112 as shown. In this example, exposed portion 111 will have a length equal to the first distance 110, whereas unexposed portion 112 will have a length equal to a second distance 113 that corresponds to the distance between a second end 114 of cuff section 103 and the point of attachment of cuff section 103 to the inside edge surface 108 of sleeve portion 101. In some non-limiting examples, second distance 113 may be between about 1 and 10 inches, optionally between about 1 and 5 inches, and optionally about 2 inches.

It should be understood that while the example barrier sleeve 102 shown in FIG. 1 comprises a cuff section 103, a gasket section 104, and a funnel section 105 as described herein, the barrier sleeve of the present disclosure is not necessarily limited by this figure. For example, the barrier sleeve may comprise only one or two of the sections described herein, such as only cuff section 103, only exposed cuff section 111, only gasket section 104, or only funnel section 105. In another example, the barrier sleeve may comprise only funnel section 105 and cuff section 103, wherein a second end 114 of cuff section is provided at a first end 116 of funnel section 105. In another example, the barrier sleeve may comprise only the gasket section 104, which may or may not be attachable and/or attached to sleeve portion 101.

Additionally or alternatively, it should be understood that while the example barrier sleeve 102 shown in FIG. 1 is attachable and/or attached to sleeve portion 101 at the second end 115 of funnel section 105 and at cuff section 103, the present disclosure is not necessarily limited in this way. For example, barrier sleeve 102 may be attachable and/or attached to sleeve portion 101 at only the second end 115 of funnel section 105 or only at cuff section 103 as shown. Additionally or alternatively, sleeve portion 101 may be attachable and/or attached to the funnel section 105 at a certain distance from the second end 115 thereof. Alternatively, barrier sleeve 102 may not be attachable and/or attached to sleeve portion 101 at all and may be presented as a "stand alone" medical device. In this instance, the funnel section may be used by a wearer to aseptically don and doff the stand alone device.

Additionally or alternatively, it should be understood that while the example barrier sleeve 102 shown in FIG. 1 is attachable and/or attached to sleeve portion 101 throughout an entire circumference of barrier sleeve 102 and sleeve portion 101, the present disclosure is not necessarily limited in this way. For example, only a portion of the circumference of the second end 115 of funnel section 105 may be attachable and/or attached to an inside surface of sleeve portion 101. Additionally or alternatively, only a portion of the circumference of cuff section 103 may be attachable and/or attached to sleeve portion 101.

Figure 4:
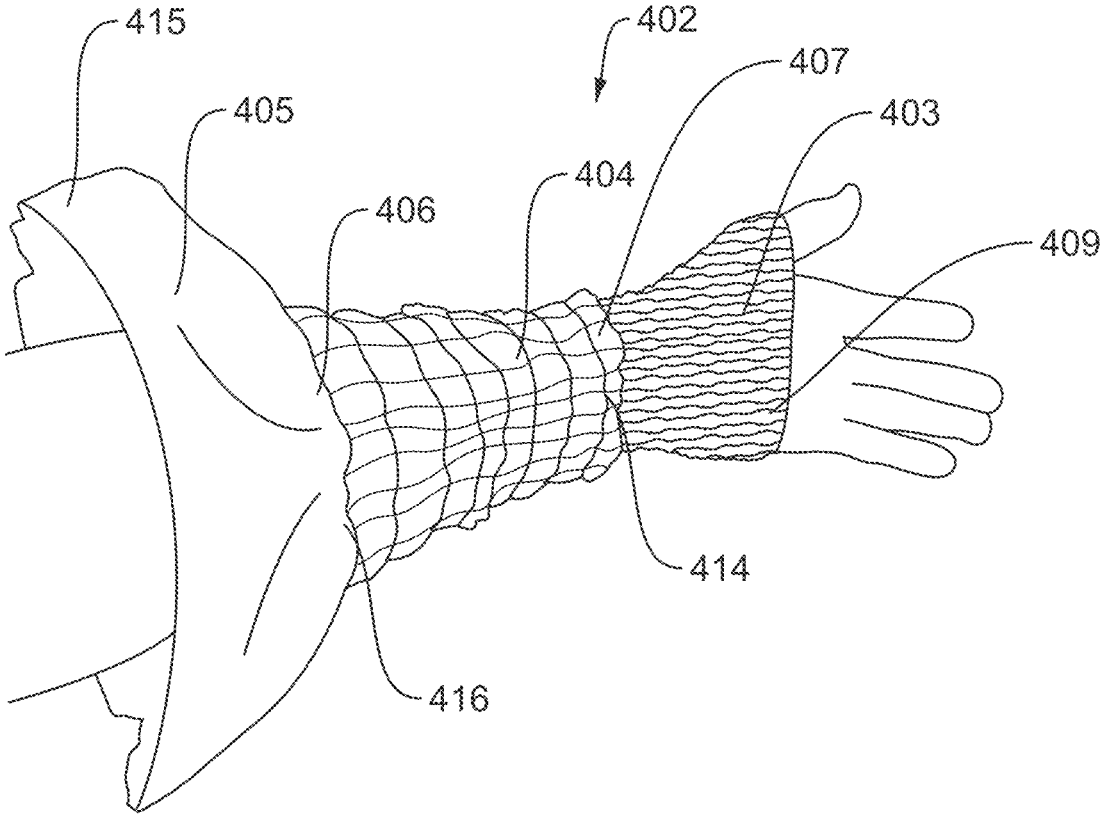
FIG. 4 shows an example barrier sleeve according to aspects of the present disclosure.

FIG. 4 shows an example barrier sleeve 402 as described in relation to FIG. 1 with features similar to those shown in FIG. 1, including a cuff section 403 having a first end 409 and a second end 414, a gasket section 404 having a first end 407 and a second end 406, and a funnel section 405 having a first end 416 and a second end 415.

The barrier sleeve according to the present disclosure is configured to provide reduced fluid transmission between a wearer and an outside environment. As used herein, a "fluid" refers to any fluid that may be found in a medical setting, including, but not limited to, bodily fluids (e.g., blood, perspiration, urine), medical fluids (e.g., sterilization fluids, intravenous fluids), and the like.

According to some aspects, reduced fluid transmission may be at least partially achieved by reducing or eliminating routes of fluid exit and/or entry as compared with a medical gown used without the barrier sleeve as disclosed herein. For example, a medical gown used without the barrier sleeve of the present disclosure may, when used in conjunction with medical gloves as known in the art, provide fluid exit and/or entry at or near the glove/gown interface due to displacement, rolling, and/or folding of the glove during use. The barrier sleeve according disclosure may reduce or eliminate the existence of this displacement, rolling, and/or folding at least in part due to the gasket material as described herein. Without wishing to be limited by theory, it is hypothesized that the gasket material according to the present disclosure may provide friction at and around the glove/gown interface sufficient to reduce or eliminate displacement, rolling, and/or folding of the glove. Additionally or alternatively, the gasket material according to the present disclosure may provide one or more lateral channels at and around the glove/gown interface as described herein sufficient to reduce or eliminate displacement, rolling, and/or folding of the glove. It should be understood that while the present disclosure describes a medical glove, other types of gloves may be used, such as an industrial glove (i.e., a glove used in a potentially hazardous industrial environment).

In another example, a medical gown used without the barrier sleeve of the present disclosure, when used in conjunction with medical gloves as known in the art, may provide longitudinal or substantially longitudinal fluid channels at the glove/gown interface due to loosely gathered gown material proximal the bead of the glove. The barrier sleeve according to the present disclosure may reduce or eliminate the existence of such longitudinal fluid channels at the glove/gown interface at least in part due to the gasket material as described herein. Without wishing to be limited by theory, it is hypothesized that gasket material according to the present disclosure may provide volume and/or friction at the glove/gown interface sufficient to reduce or eliminate the existence of such longitudinal fluid channels as described herein. In one example wherein the gasket material is a readily compressible gathered gasket material as described herein, the gasket section may comprise at least one channel that is lateral or substantially lateral relative to the length or longitudinal direction of the gasket section (e.g., a channel that extends along the circumference of a tubular gasket section). When used in conjunction with medical gloves as known in the art, the bead of a medical glove may create the at least one channel in the gathered gasket material when a glove is pulled over the gathered gasket material as described herein. In this way, longitudinal or substantially longitudinal fluid channels that would be otherwise formed at the glove/gown interface may be reduced or eliminated.

In one example, the longitudinal channels or substantially longitudinal channels formed by the oversized gown sleeve being cinched or otherwise tightened are interrupted or otherwise blocked by the elastic glove bead being engaged with (e.g., retainably held within) the compressible gasket section with a portion of the gown sleeve also being retainably held between the glove bead and the gasket section.

According to some aspects, the barrier sleeve according to the present disclosure does not require any additional donning or doffing steps compared with steps as known in the art for donning and doffing medical gowns and medical gloves, alternatively referred to herein as conventional donning or doffing steps. That is, the barrier sleeve, the medical gown, and/or a system comprising the same may be configured such that donning and/or doffing the barrier sleeve, the medical gown, and/or the system is substantially identical to donning and/or doffing a medical gown without the barrier sleeve. For example, donning a medical gown having the barrier sleeve according to the present disclosure may not require an additional folding, tucking, and/or rolling step that would not be required to don or doff a similar medical gown that does not comprise a barrier sleeve as described herein. According to some aspects, unconventional donning and/or doffing steps may include steps that are not described in, for example, the AORN Guidelines for Perioperative Practice: Sterile Technique, published May 27, 2020, the contents of which are incorporated in their entirety herein.

According to some aspects, all or a portion of the barrier sleeve, medical gown, and/or medical glove as described herein may be sterilized via a sterilization process as known in the art. Example sterilization processes include, but are not limited to, ethylene oxide (EO) sterilization, gamma radiation, ebeam radiation, STERRAD®, and dry or steam heat.

According to some aspects, all or a portion of the barrier sleeve and/or the interface between the barrier sleeve and the gown, and a gown having a barrier sleeve as described herein may meet one or more performance standards including, but not limited to, performance standards for tensile strength (e.g., ASTM D5034, ASTM D1682), tear resistance (e.g., ASTM D5587 (woven), ASTM D5733 (nonwoven), ASTM D1424), seam strength (e.g., ASTM D751 (stretch woven or knit)), lint generation (e.g., ISO 9073 Part 10), abrasion resistance (e.g. ASTM D4966), water vapor transmission (e.g., ASTM F1868 Part B, ASTM D6701, ASTM E96/E96M, ASTM D737-75), or a combination thereof. Additionally or alternatively, all or a portion of the barrier sleeve and/or the interface between the barrier sleeve and the gown, and a gown having a barrier sleeve as described herein may meet the requirements of Level 1, Level 2, Level 3, or Level 4 of ANSI/AAMI PB 70. Additionally or alternatively, all or a portion of the barrier sleeve and/or the interface between the barrier sleeve and the gown, and a gown having a barrier sleeve as described herein may meet one or more requirements for viral penetration as specified by ASTM F1671.

The present disclosure is also directed to a system comprising a barrier sleeve as described herein. According to some aspects, the system may comprise a medical gown and a barrier sleeve or portion thereof as described herein.

Figure 2:
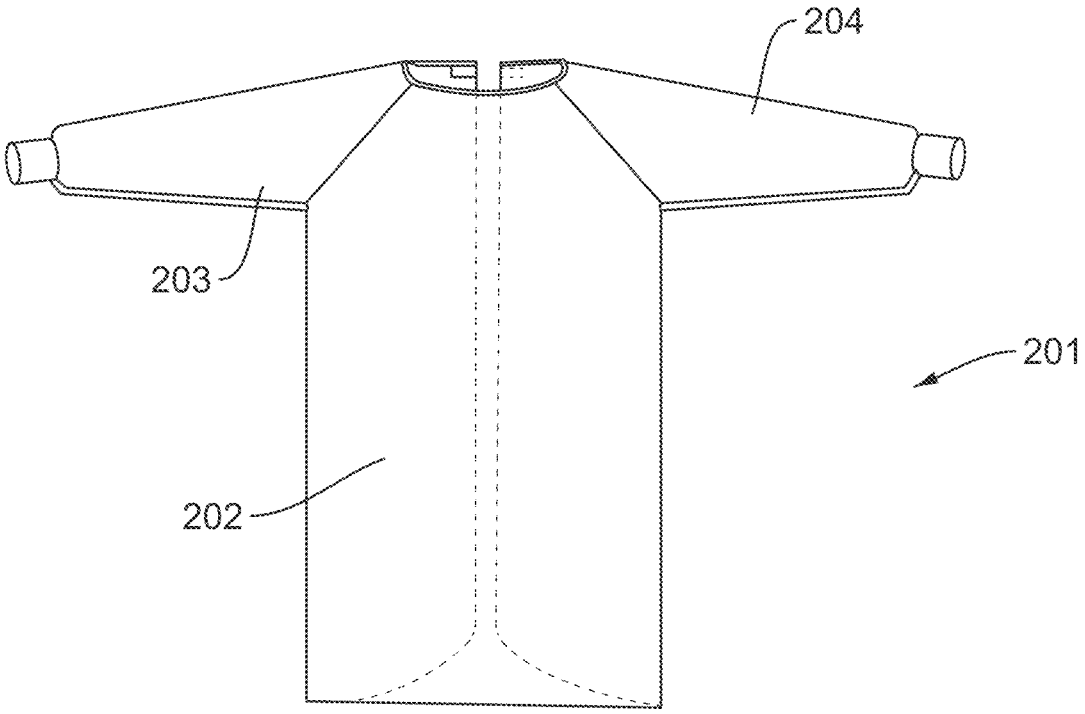
FIG. 2 shows an example medical or protective gown according to aspects of the present disclosure.
Figure 5:
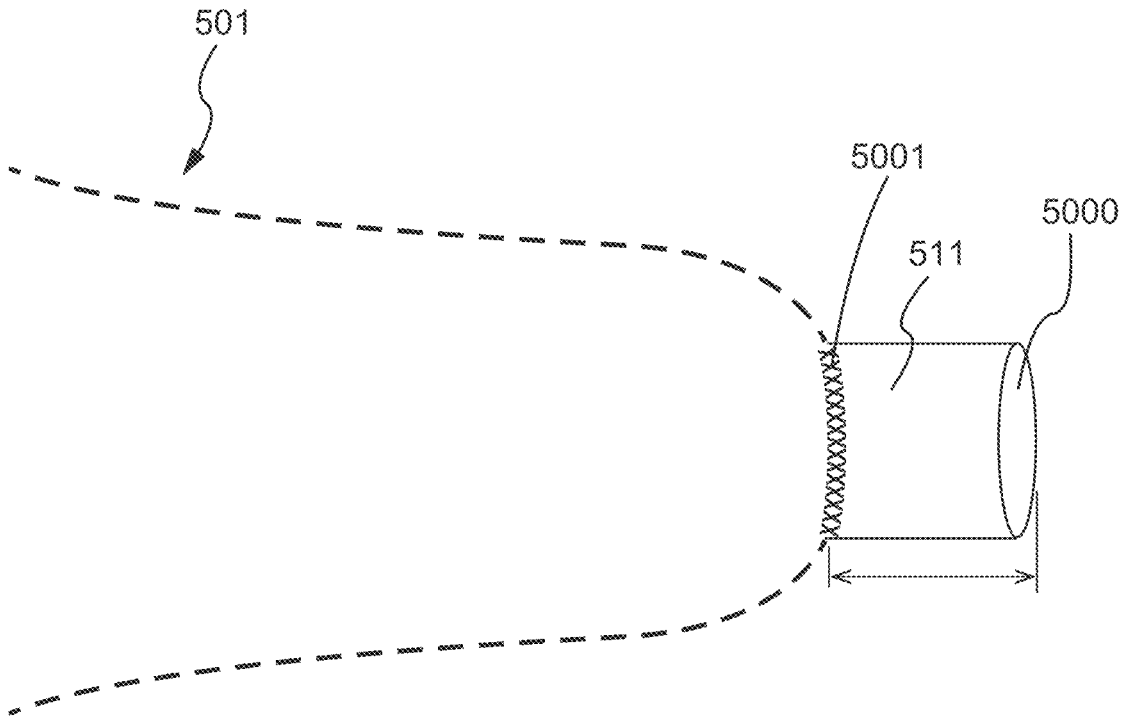
FIG. 5 shows a diagram view of an example system according to aspects of the present disclosure.

For example, FIG. 2 shows a medical gown 201 having a body portion 202, a first arm portion 203, and a second arm portion 204. At least one of the first arm portion 203 and the second arm portion 204 may comprise a barrier sleeve attached thereto as described herein. Alternatively, the system may comprise a medical gown and a barrier sleeve that is attachable thereto, wherein the barrier sleeve may or may not be attached to the medical gown. According to some aspects, the system may comprise only a portion of the barrier sleeve as described herein. For example, the system may comprise a medical gown as described herein having only the cuff section as described herein, only the gasket section as described herein, and/or only the funnel section as described herein. In another non-limiting example, the system may comprise a medical gown and only a portion of the cuff section, the gasket section, and/or the funnel section as described herein. For example, FIG. 5 shows an example sleeve portion 501 of a medical gown similar to sleeve portion 101 as shown in FIG. 1. In this example, the system may include only an exposed portion 511 of a cuff section as described in relation to FIG. 1, exposed portion 511 having a first end 5000 and a second end 5001 that is attached to sleeve portion 501.

The system according to the present disclosure may further include a medical glove as described herein. As used herein, the term "medical glove" refers to a glove suitable for use in a medical setting as described herein. According to some aspects, the medical glove may comprise any glove material useful in the art, including but not limited to natural rubber and/or synthetic elastomers. Non-limiting examples of natural rubbers include rubber made from hevea rubber latex and guayule rubber latex, and any other natural rubbers known in the art. Non-limiting examples of synthetic rubbers include polyisoprene, polychloroprene, polyurethane, polybutadiene, nitrile, styrene butadiene rubber, block copolymers of styrene and butadiene, block copolymers of styrene and isoprene, mixtures of these elastomers and vinyl, and the like. Other synthetic rubbers that can be used include acrylic diene block copolymers, acrylic rubber, butyl rubber, EPDM rubber, chlorosulfonated polyethylene rubber and fluororubber. Example glove materials useful according to the present disclosure include those described in U.S. Pat. No. 10,647,886, the contents of which are incorporated herein in their entirety by reference.

Figure 3:
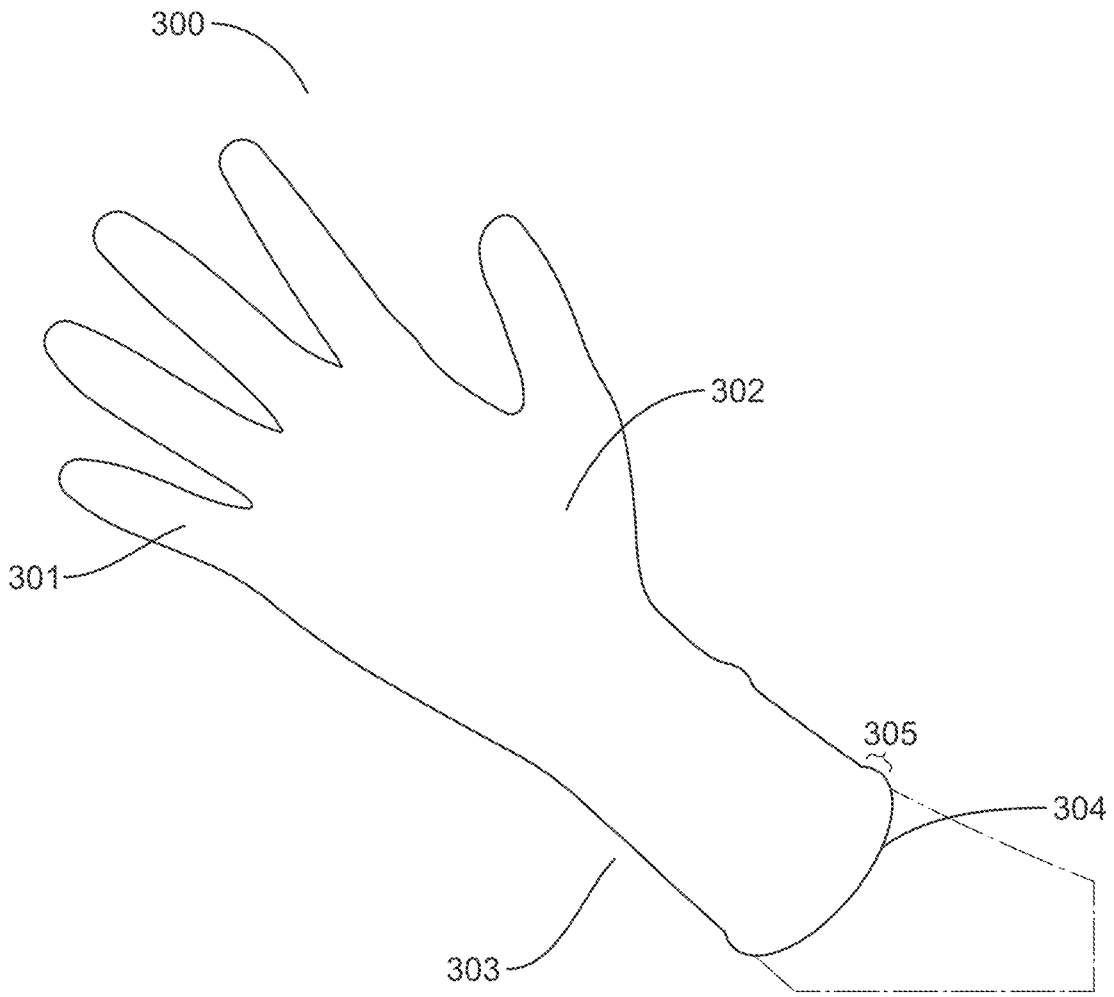
FIG. 3 shows an example glove according to aspects of the present disclosure.

FIG. 3 shows an example medical glove useful according to the present disclosure. As shown in FIG. 3, the glove 300 may comprise one or more finger portions 301, a palm portion 302, a cuff portion 303, and a bead 304. It should be understood the bead 304 may be a portion of the glove 300 proximal the cuff portion 303 that has been rolled as known in the art. However, it should be understood that the medical glove is not particularly limited in this way and that any means of forming a bead as known in the art may be provided.

According to some aspects, the bead 304 may be configured such that, when used with one or more other components of the system as described herein, reduced fluid transmission between a wearer and an outside environment is provided. For example, it has been found that by providing a bead having a certain thickness 305 (e.g., the diameter of the rolled portion), reduced fluid transmission when used in conjunction with one or more other components of the system as described herein may be achieved. In some non-limiting examples, the bead may have a thickness of at least about 2 mm, optionally at least about 2.5 mm, optionally at least about 3 mm, optionally at least about 3.5 mm, and optionally at least about 4 mm. In some non-limiting examples, the bead may have a thickness of about 2 mm, optionally about 2.5 mm, optionally about 3 mm, optionally about 3.5 mm, and optionally about 4 mm. It should be understood that the systems as described herein may comprise a single pair of gloves or a double pair of gloves, wherein each glove independently has the same bead thickness or a different bead thickness from another glove in the system. It should be understood that in the case of a double pair of gloves, two gloves may be worn on each hand. In this example, the bead of each gloves may be substantially aligned with the bead of another glove on the same hand. Alternatively, the outer glove bead may be provided proximal (i.e., nearer the body than) the inner glove bead on a wearer's arm, as known in the art. In addition, in the case where two gloves may be worn on each hand, the bead of each glove may have approximately the same thickness as the bead of another glove on the same hand. Alternatively, the outer glove bead may be thicker than the inner glove bead, as known in the art.

According to some aspects, the bead may be configured to engage with and sealingly interact with one or more components of the system, such as with the gasket section as described herein, such that penetration of fluids towards the cuff section is reduced. For example, when provided with a gasket section having a gathered gasket material as described herein, the glove bead may be configured to press down into the gathered gasket material to form one or more channels that are substantially lateral to the length dimension of the gasket section (e.g., along the circumference of a tubular gasket section) when worn by a user, sufficient to sealingly interact with the gasket section as described herein. It should be understood that in the cases of a system comprising more than one pair of gloves, gloves may be donned in a layered arrangement wherein the outer glove bead of each glove is substantially proximal to another glove bead in the layered arrangement, as known in the art. The glove bead may be oriented so it is rolled outwards, or rolled inwards towards skin when worn.

According to some aspects, the system may comprise all three of a barrier sleeve, a medical gown, and one or more medical gloves as described herein. In this example, the system may be configured for use in a medical setting as known in the art. For example, the system may be configured such that a wearer may don the medical gown having the barrier sleeve attached thereto and subsequently don one or more medical gloves on each hand (including a single glove on each hand and/or two gloves on each hand in a double-layered arrangement) such that the medical glove(s) overlap at least a portion of a sleeve portion of the medical gown and/or at least a portion of the barrier sleeve as described herein. The system may be configured such that additional steps compared with steps as known in the art for donning medical gowns and medical gloves are not required. For example, donning a medical gown having the barrier sleeve attached thereto and/or donning a medical glove as described herein may not require an additional folding, tucking, and/or rolling step that would not be required to don or doff a similar medical gown and/or medical glove not provided as part of a system as described herein.

According to some aspects, all or a portion of the system may be sterilized by a sterilization process as described herein. It should be understood that the components of the system may be sterilized together and/or one or more of the components of the system may be individually sterilized. In one non-limiting example, a medical gown provided with a gasket section as described herein may be sterilized within a transfer wrap inside of a vented bag.

According to some aspects, all or a portion of the system may be single-use. Alternatively, one or more portions of the system may individually be multi-use. In one non-limiting example, the system may comprise a multi-use gown and one or more single use gasket sections as described herein.

Methods of making and using the barrier sleeve, medical gown, and/or systems described herein are also included. In one non-limiting example, the method may comprise providing a barrier sleeve having a funnel section, a gasket section, and a cuff section as described herein, and attaching at least one of the funnel section and the cuff section to an inside surface of a sleeve portion of a medical gown as described herein.

Figure 6A:
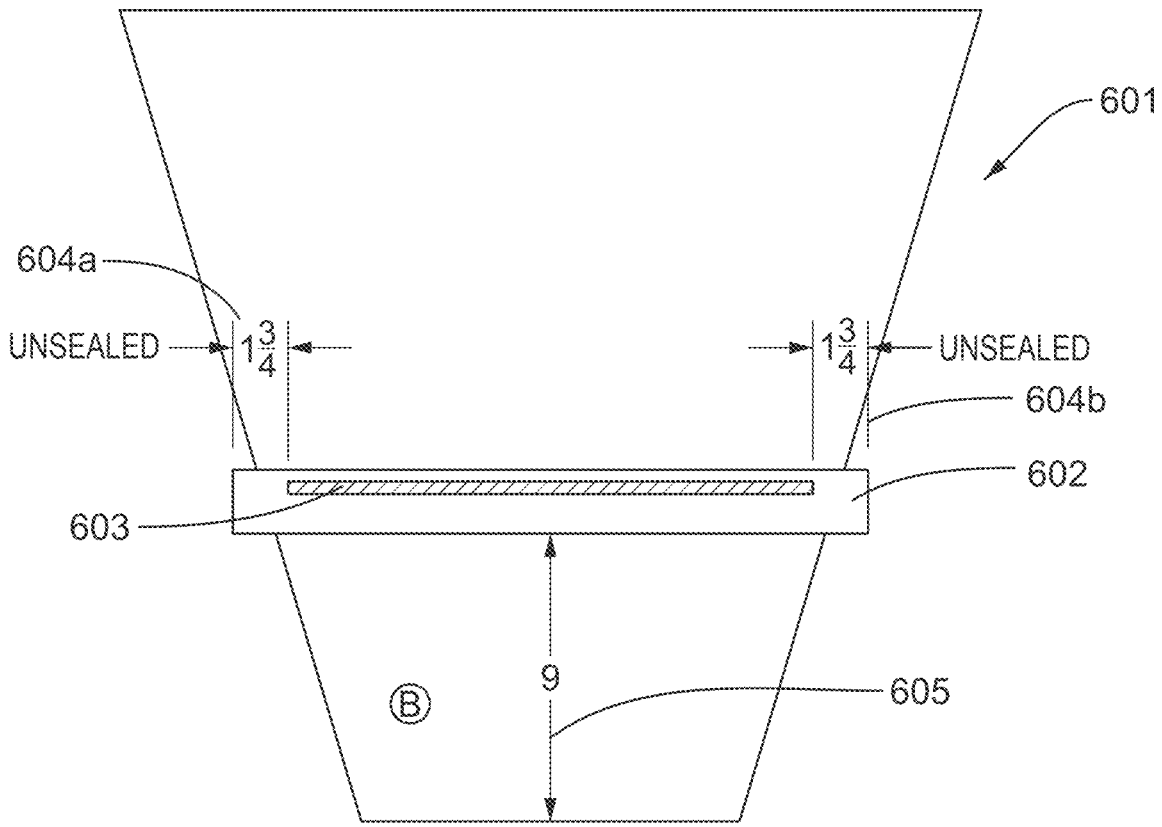
FIG. 6A shows an aspect of an example method of making a system as described herein.

FIGS. 6A-6G show non-limiting aspects of an example method of making a medical gown sleeve having a barrier sleeve attached thereto as described herein. In particular FIG. 6A shows a generally trapezoidal component 601 for forming an arm portion of a medical gown as described herein. As shown in FIG. 6A, the method may comprise attaching a flap portion 602 to component 601 at a first distance 605 from an end of component 601. First distance 605 may be, for example, between about 5 and 15 inches, optionally between about 6 and 12 inches, and optionally about between about 8 and 9 inches. According to some aspects, flap portion 602 may be attached to component 601, for example, via a seal 603 as described herein. FIG. 6A shows that flap portion 602 may have two unsealed portions 604*a*, 604*b* that are not attached to component 601. Unsealed portions 604*a*, 604*b* may independently have a length of between about 1 and 3 inches, optionally about 1.75 inches.

Figure 6B:
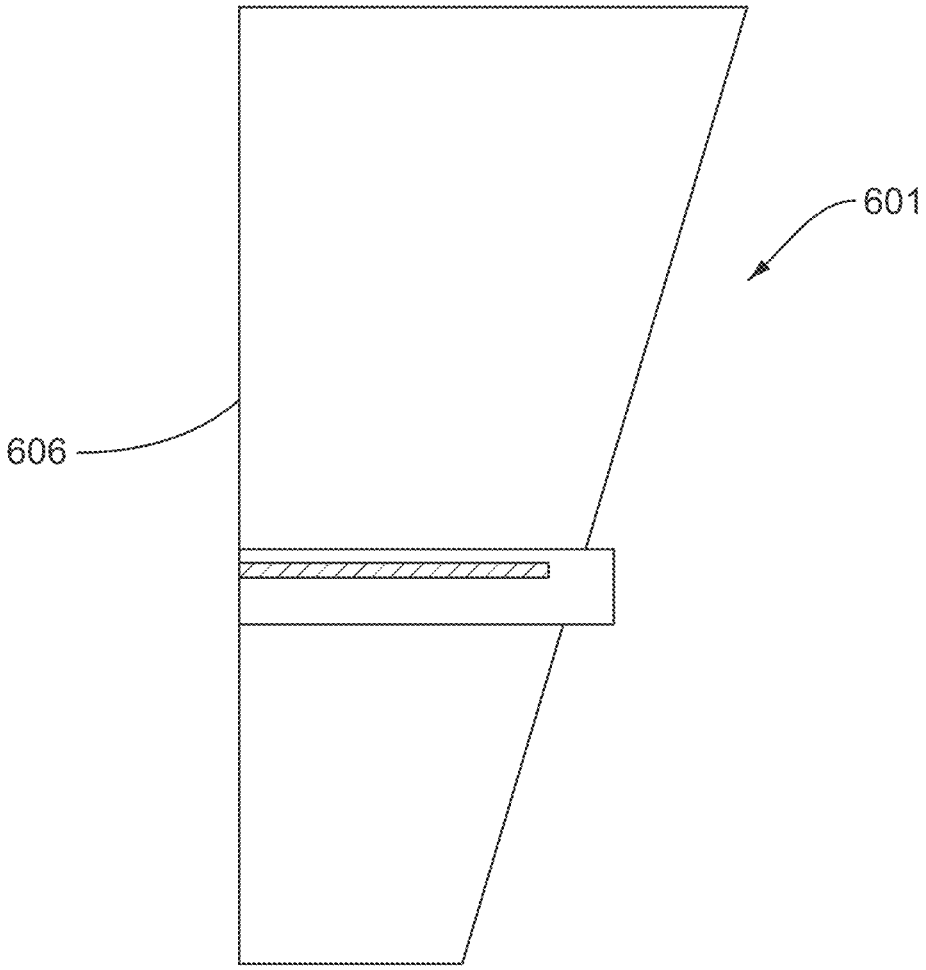
FIG. 6B shows an aspect of an example method of making a system as described herein.
Figure 6C:
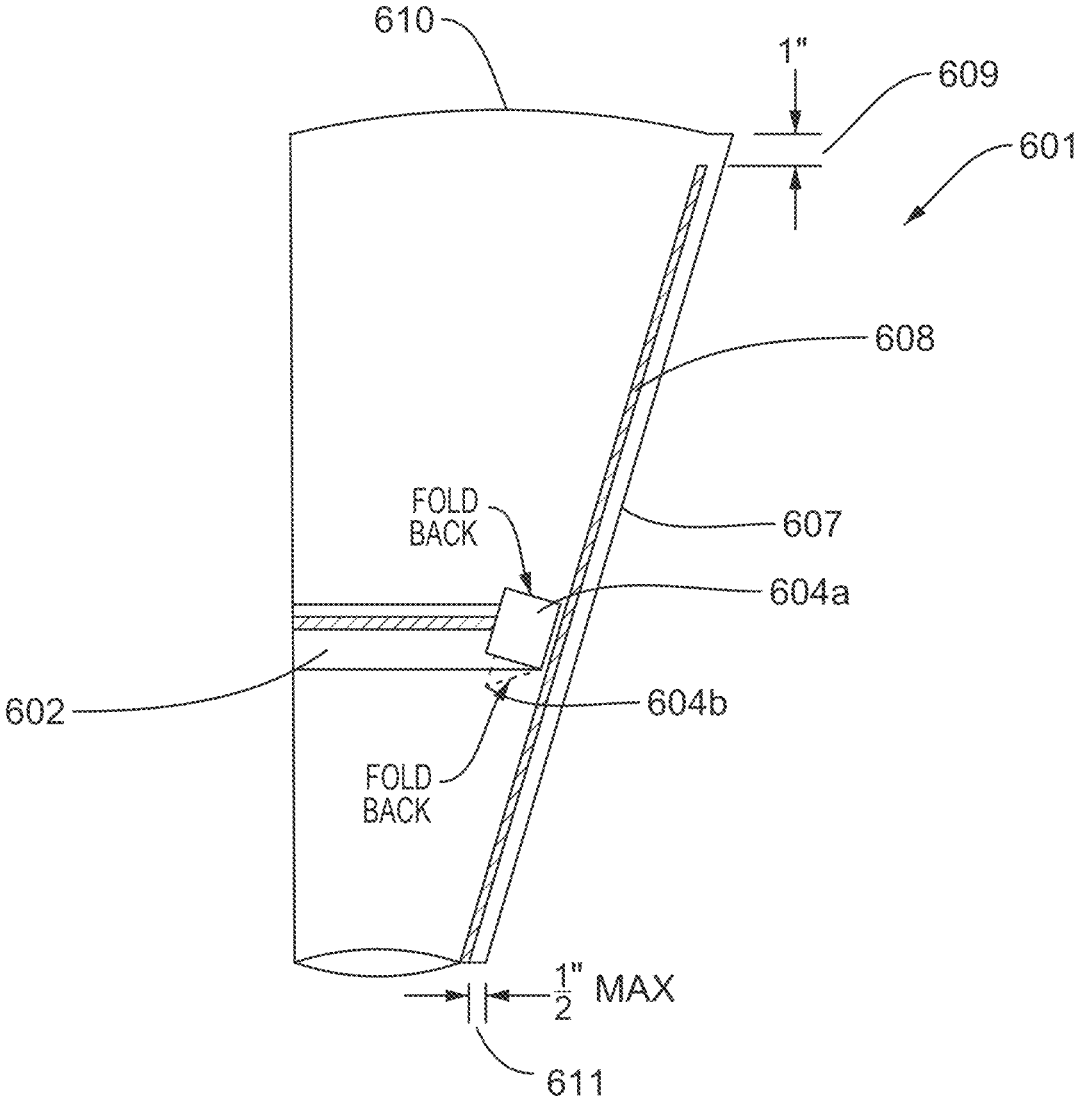
FIG. 6C shows an aspect of an example method of making a system as described herein.
Figure 6D:
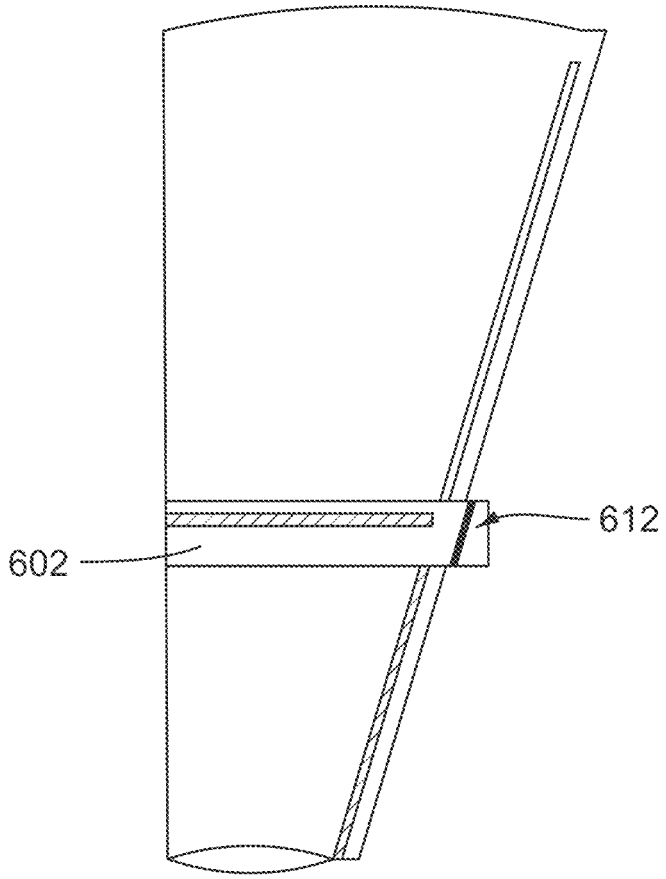
FIG. 6D shows an aspect of an example method of making a system as described herein.

FIGS. 6B-6D show example steps for forming an arm portion of a medical gown from component 601 as shown in FIG. 6A. For example, as shown in FIG. 6B, the method may comprise folding component 601 in half along a longitudinal axis 606. As shown in FIG. 6C, the method may comprise folding one or both of unsealed portions 604*a*, 604*b* of flap portion 602. The method may then comprise joining free ends 607 of component 601, for example, via a seal 608. As shown in FIG. 6C, seal 608 may optionally be provided a certain distance 609 from a proximal end 610 of component 601. Distance 609 may be between about 0.01 and 2 inches, optionally about 1 inch. Additionally or alternatively, seal 608 may optionally be provided a certain distance 611 from free ends 607. Distance 611 may be between about 0.01 and 1 inch, optionally about 0.5 inches.

As shown in FIG. 6D, the method may comprise joining ends 612 of flap portion 602 by any joining mechanism as described herein, such as via a seal and/or sewing via a serger. A portion of ends 612 may then be optionally trimmed.

Figure 6E:
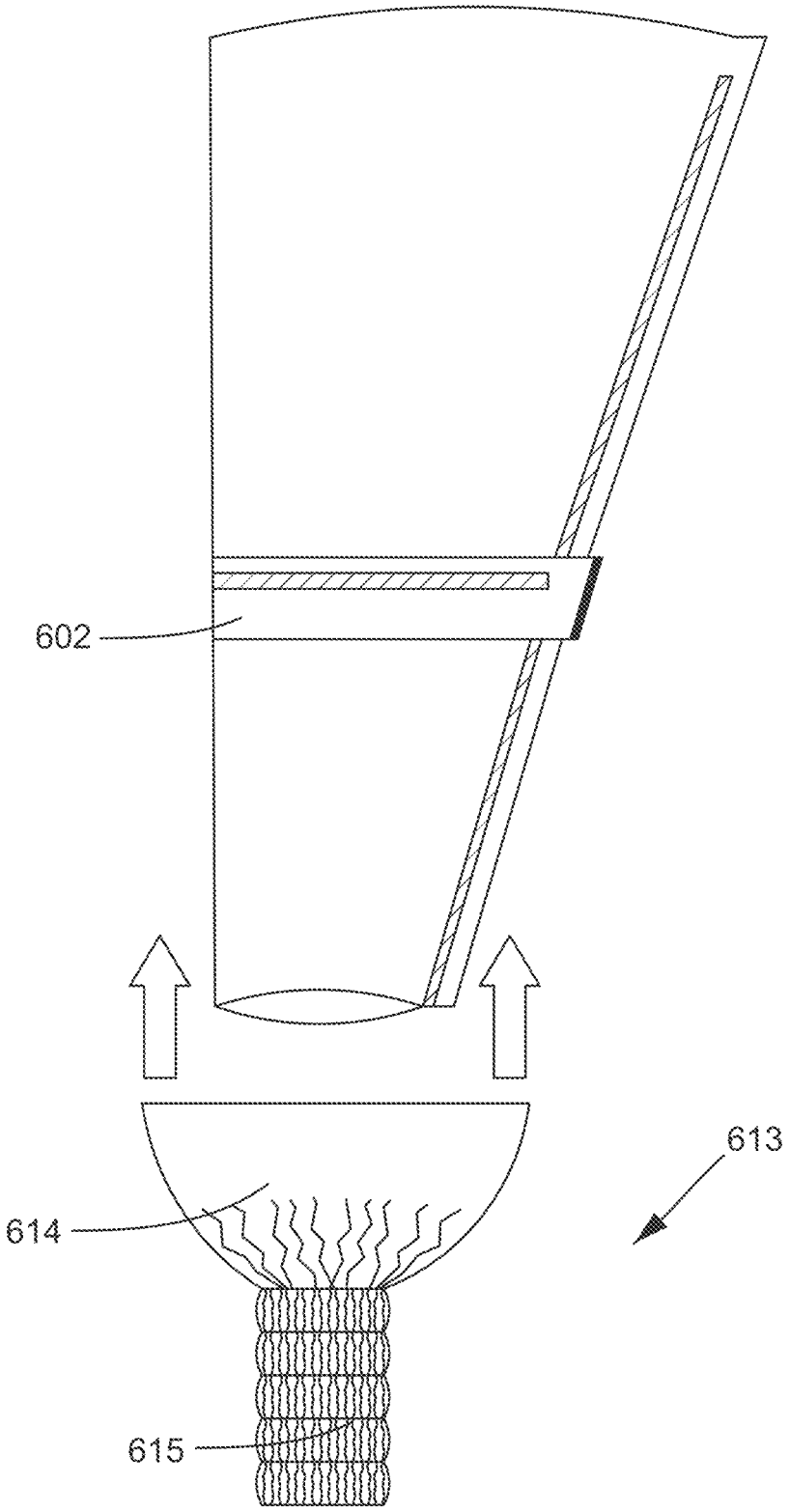
FIG. 6E shows an aspect of an example method of making a system as described herein.
Figure 6F:
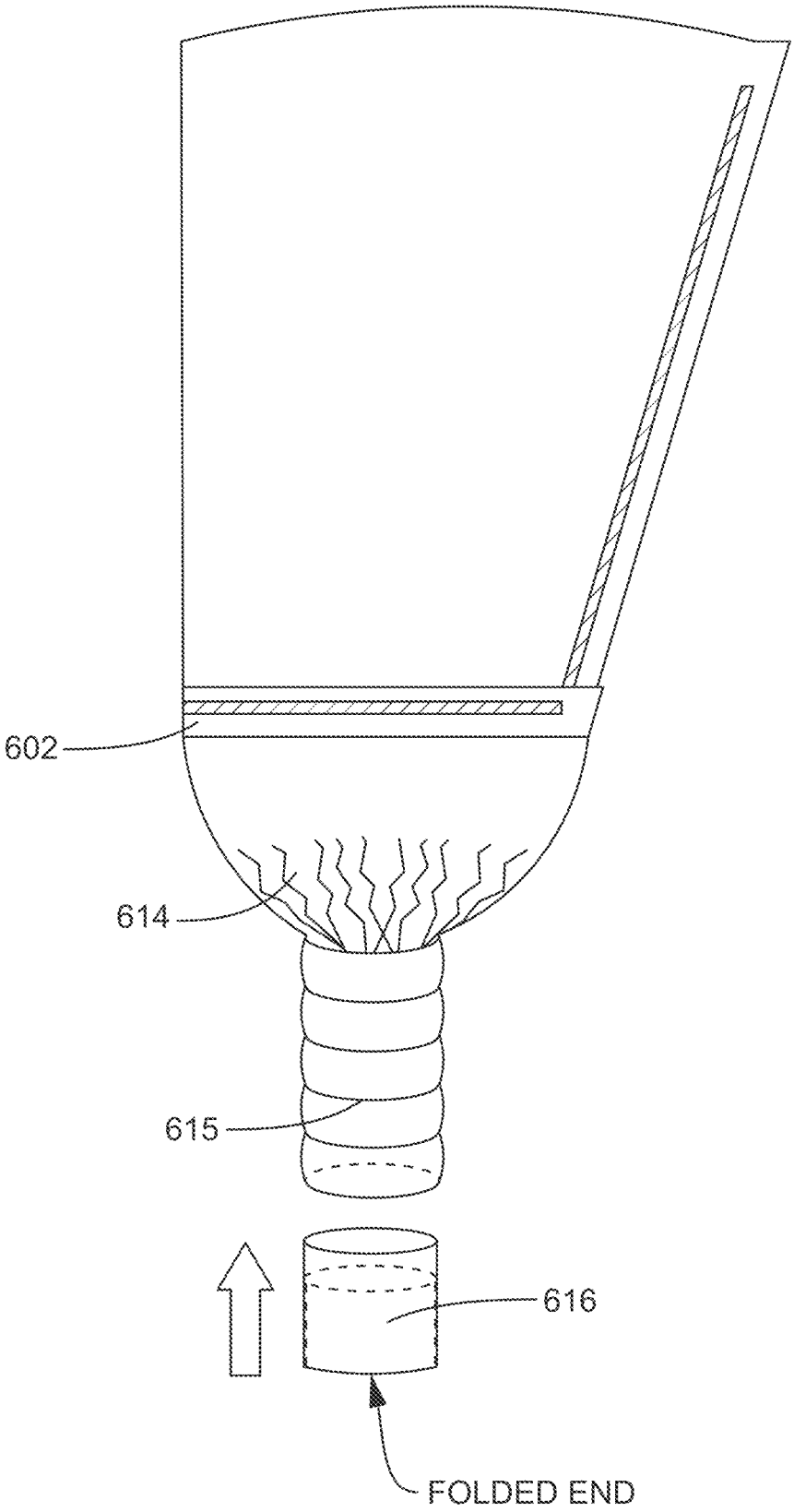
FIG. 6F shows an aspect of an example method of making a system as described herein.
Figure 6G:
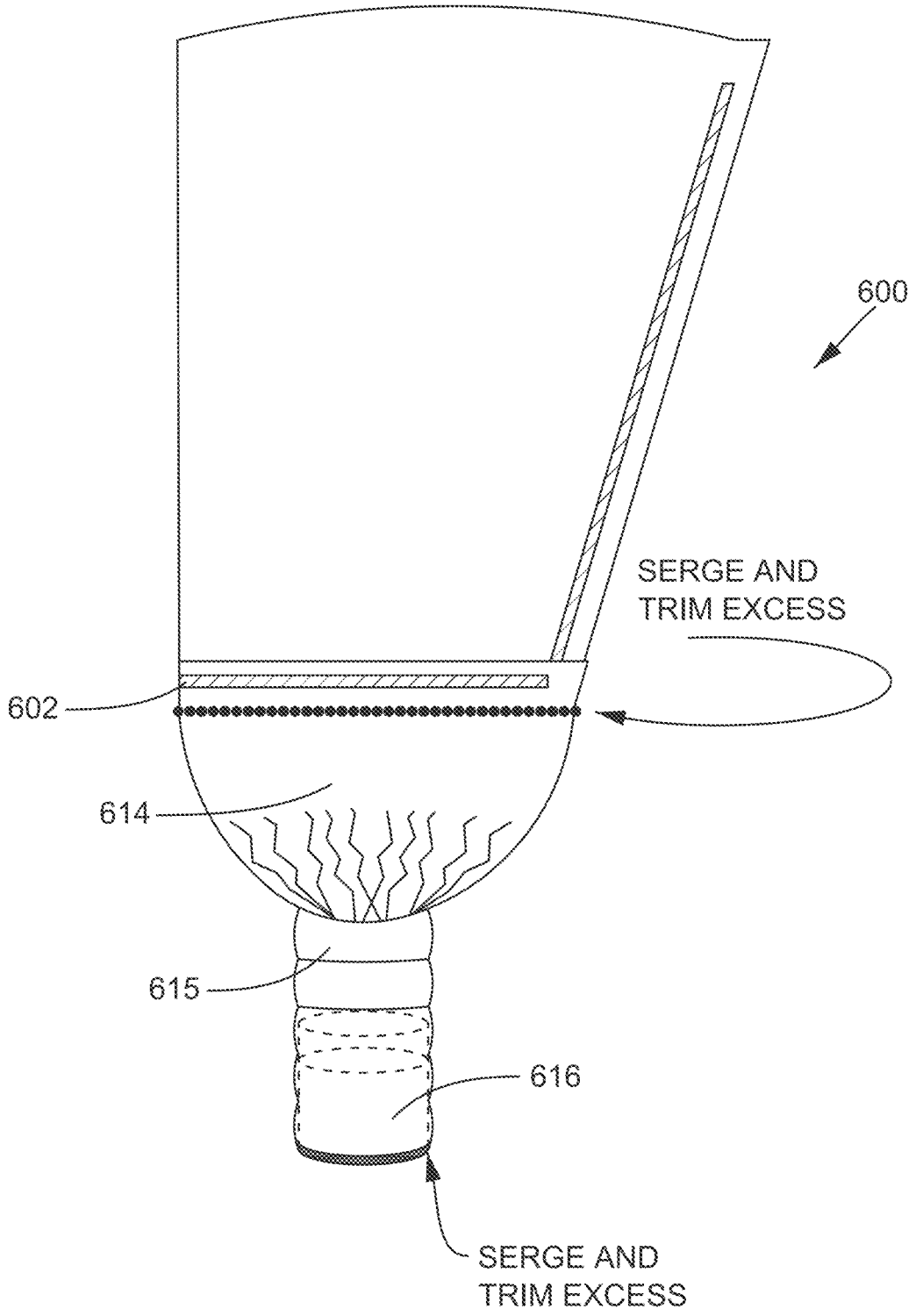
FIG. 6G shows an aspect of an example method of making a system as described herein.

As shown in FIG. 6E, the method may comprise providing a barrier sleeve or a portion thereof 613, such as a funnel section 614 and gasket section 615 as described herein. The method may comprise aligning barrier sleeve or portion thereof 613 with flap portion 602 as shown, for example, in FIG. 6F. It should be understood that if the portion of barrier sleeve 613 does not comprise, for example, a cuff section 616 as described herein, the method may comprise providing a cuff section 616 and aligning it with gasket section 615 as shown in FIG. 6F. The method may further comprising joining funnel section 614 with flap portion 602 and/or joining cuff section 616 with gasket section 615 as shown in FIG. 6G by any joining mechanism as described herein, such as via a seal and/or sewing with a serger. As shown in FIG. 6G, prior to attachment, a portion of cuff section 616 may be folded so as to provide a double thickness section. The double thickness section may have a length of approximately two inches. In this way, an end portion of cuff section 616 may be reinforced as described herein. FIG. 6G also shows that any excess material may be removed. While not shown, arm portion 600 may then be inverted in order to provide an arm portion of a medical gown having a barrier sleeve attached to an inside surface thereof as described herein.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Thus, the claims are not intended to be limited to the aspects shown herein, but are to be accorded the full scope consistent with the language of the claims, wherein reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. Nothing disclosed herein is intended to be dedicated to the public regardless of whether such disclosure is explicitly recited in the claims.

The following non-limiting examples illustrate particular embodiments of the articles and processes as described herein. The examples are not meant to be comprehensive of the entire scope of the articles and processes.

EXAMPLES

Example I: Preparation of Glove/Gown Interface

First, three inventive medical gowns having a barrier sleeve as described herein were manufactured. Each of the barrier sleeves was formed of a cuff section, a gasket section, and a funnel section. The gasket section of each barrier sleeve was formed of two layers of a nonwoven material with 1100 dtex elastic bands between the layers of nonwoven material. Each elastic band had a percent elongation of 325%. Additional properties of the gasket sections were as shown in Table 1.

TABLE 1

Gasket Section Properties

| Inventive Gown Barrier Sleeve | Nonwoven material | Manufacturing process |
|---|---|---|
| 1 | 2 webs of 25 gsm lightly bonded high loft SMS | Hotmelt Strand lamination, 1 inch spacing |
| 2 | 2 webs 20 gsm SMS | Hotmelt Strand Lamination, 1 inch spacing |
| 3 | 2 webs 20 gsm SMS | Sewn together using elastic strand, 1 inch spacing |

The compressibility of each gasket section was measured using a B.C. Ames Model AQD-2110N Caliper gauge using a 1-inch-diameter measuring foot. The thickness measurements were taken with and without a 0.5375 lb weight added. The results of the measurements are shown in Table 2. These measurements were made on the flattened cuff, for two layers of the gasket material. When doing the measurements the measuring foot was slowly lowered onto the flattened cuff to prevent compaction from the foot dropping onto the surface rapidly.

TABLE 2

Compressibility of Gasket Section

| Inventive Barrier Sleeve | No Weight (Thickness in mm) | With Weight (Thickness in mm) | Change in Thickness (mm) | % Thickness Change |
|---|---|---|---|---|
| 1 | 9.11 | 3.30 | −5.81 | −64% |
| 2 | 11.20 | 5.15 | −6.05 | −54% |
| 3 | 8.37 | 4.08 | −4.29 | −51% |

Example II: Spray Test at Glove/Gown Interface

First, four glove/gown interfaces were formed. Each interface included one of a Comparative Gown, Example Inventive Gown 1, Example Inventive Gown 2, and Example Inventive Gown 3 as described in Test I. The comparative gown was identical to the inventive gowns except it did not include a barrier sleeve as disclosed herein.

To form the glove/gown interface, a user first donned each gown and subsequently donned either a single medical glove or two medical gloves (double-gloving) per hand using a traditional donning technique, creating the glove/gown interface where the gloves overlapped the sleeve portion of the gown. Each glove had a bead with a thickness of 2 mm, 3 mm, or 4 mm, as shown in Table 3 below. With double gloving the outer glove bead is proximal to the inner glove bead as per double gloving recommendations.

Each glove/gown interface was then subjected to a 50-second spray test. Specifically, after the user donned the gown and glove(s) as described above, the user then reached the donned arm through an opening with arm vertical and with arm twisting and hand movements to simulated surgical movements, where the arm was sprayed a water/synthetic blood mixture above the glove/gown interface (i.e., proximal the glove/gown interface) for 50 seconds. The interfaces were considered to pass the spray test if the hand and/or arm of the user remained dry after spraying. A failure resulted in fluid breaching the glove/gown interface, resulting in fluid reaching the hand and/or arm of the user. The results of the test as shown in Table 3 below.

TABLE 3

| Spray Test Results | | | | | |
|---|---|---|---|---|---|
| | Total # of | 50 Sec Spray Test Results | | | |
| Gown | Spray tests | Double Glove (2 mm bead) | Single Glove (2 mm bead) | Single Glove (3 mm Bead) | Single Glove (4 mm Bead) |
| Comparative Gown | 3 | 2/2 Failed | N/A | N/A | 1/1 Failed |
| Inventive Gown 1 | 7 | 2/2 Passed | 1/2 Passed | 1/1 Failed | 2/2 Passed |
| Inventive Gown 2 | 7 | 2/2 Passed | 1/2 Passed | 1/1 Failed | 2/2 Passed |
| Inventive Gown 3 | 4 | 2/2 Passed | 1/2 Passed | N/A | N/A |

Example III: Submersion Test at Glove/Gown Interface

First, four glove/gown interfaces using a Comparative Gown, Example Inventive Gown 1, Example Inventive Gown 2, and Example Inventive Gown 3 were formed as described in Test II. In particular, a user donned each gown and subsequently donned either a single medical glove or two medical gloves (double-gloving) per hand using a traditional donning technique, creating a glove/gown interface where the gloves overlapped the sleeve portion of the gown. Each glove had a bead with a thickness of 2 mm, 3 mm, or 4 mm, as shown in Tables 4A and 4B below.

The submersion test was then performed by submerging the donned hand and forearm into a five-gallon bucket of water until the water reached three-inches above the glove/down interface. The amount of time for the water to reach the hand of the user was then measured. There was no movement of hand or twisting of the arm while submerged. The results are shown in Tables 4A and 4B below.

TABLE 4A

| Submersion Test Results | | | |
|---|---|---|---|
| | Total # of | Submersion time - Seconds to Reach Skin | |
| Gown | submersion tests | Double Glove (2 mm bead) | Single Glove (2 mm bead) |
| Comparative Gown | 4 | 8, 4 | N/A |
| Inventive Gown 1 | 3 | 34 | N/A |
| Inventive Gown 2 | 4 | 50, 48 | N/A |

TABLE 4A-continued

| Submersion Test Results | | | |
|---|---|---|---|
| | Total # of | Submersion time - Seconds to Reach Skin | |
| Gown | submersion tests | Double Glove (2 mm bead) | Single Glove (2 mm bead) |
| Inventive Gown 3 | 3 | N/A | 25 |

TABLE 4B

| Submersion Test Results | | | | |
|---|---|---|---|---|
| | | Submersion time - Seconds to Reach Skin | | |
| Gown | Total # of submersion tests | Single Glove (4 mm bead) | Double Glove (4 mm bead) | Double Glove (3 mm bead) |
| Comparative Gown | 4 | N/A | 10 | 7 |
| Inventive Gown 1 | 3 | N/A | 155 | 12 |
| Inventive Gown 2 | 4 | N/A | 92 | 265 |
| Inventive Gown 3 | 3 | 32 | 40 | N/A |

Example IV: Wear Study

Figure 7:
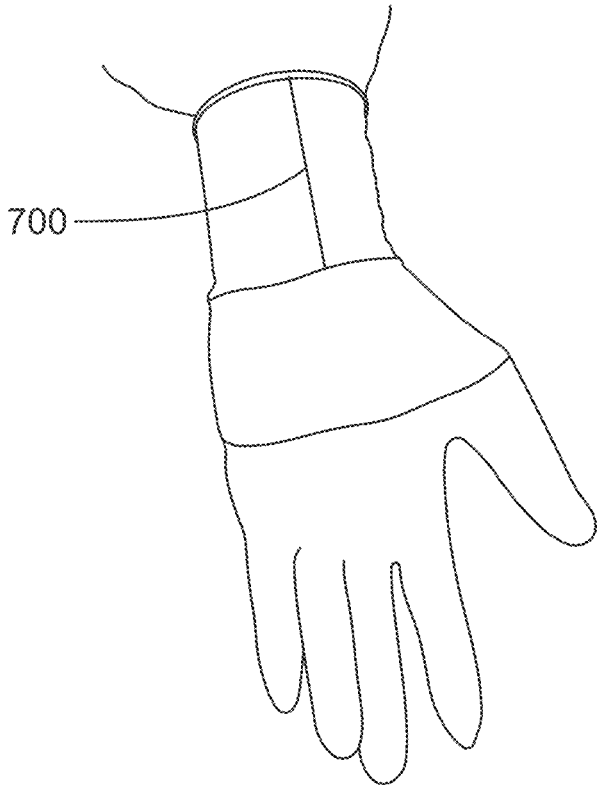
FIG. 7 shows the distance measured in Example IV.

Sixteen participants donned a medical gowns having a barrier sleeve as described herein (i.e., an inventive sleeve) and/or a medical gown without a barrier sleeve (i.e., a control sleeve). The sleeves were worn consecutively (i.e., first a medical gown having the inventive sleeves followed by a medical down having control sleeves) or simultaneously (i.e., a medical gown having one inventive sleeve and one control sleeve). Each participant then conducted normal laboratory and/or clinical activities for a two hour period using each sleeve with a glove overlapping the sleeves. After the two hour period, the distance 700 from the glove bead to a first end of the sleeve's cuff section was measured, as shown in FIG. 7.

Figure 8A:
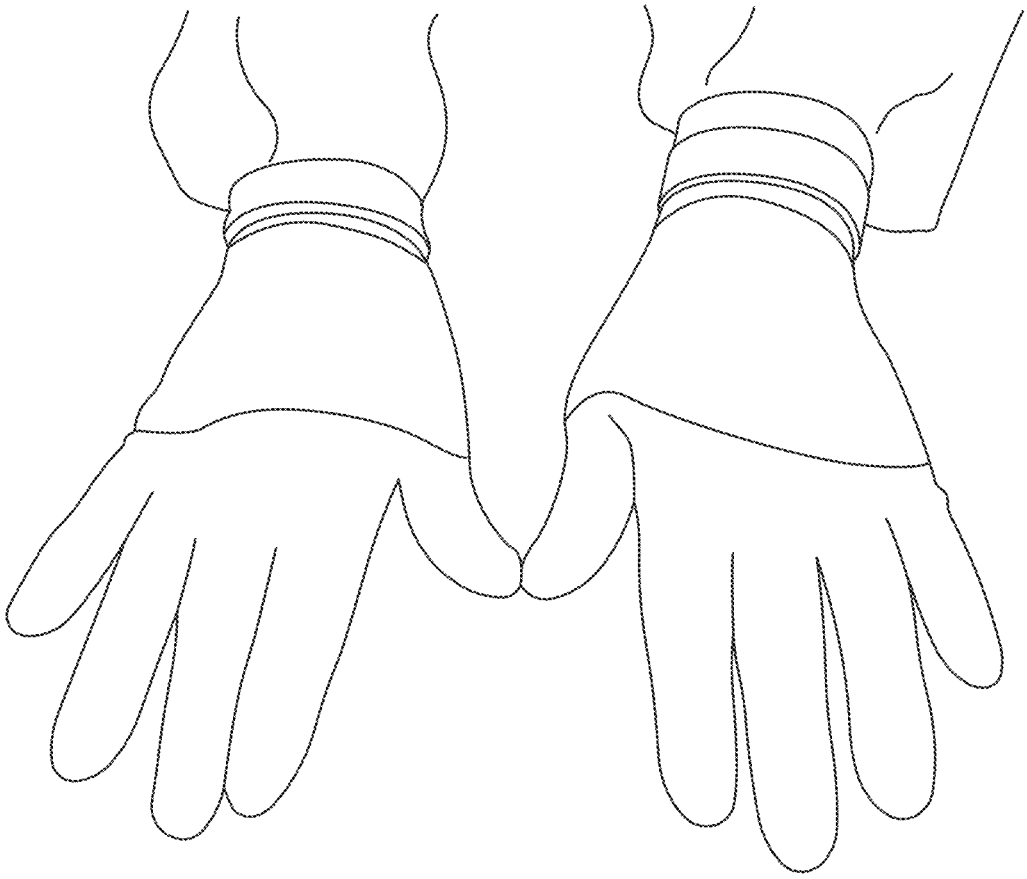
FIG. 8A shows two control sleeves as described in Example IV.
Figure 8B:
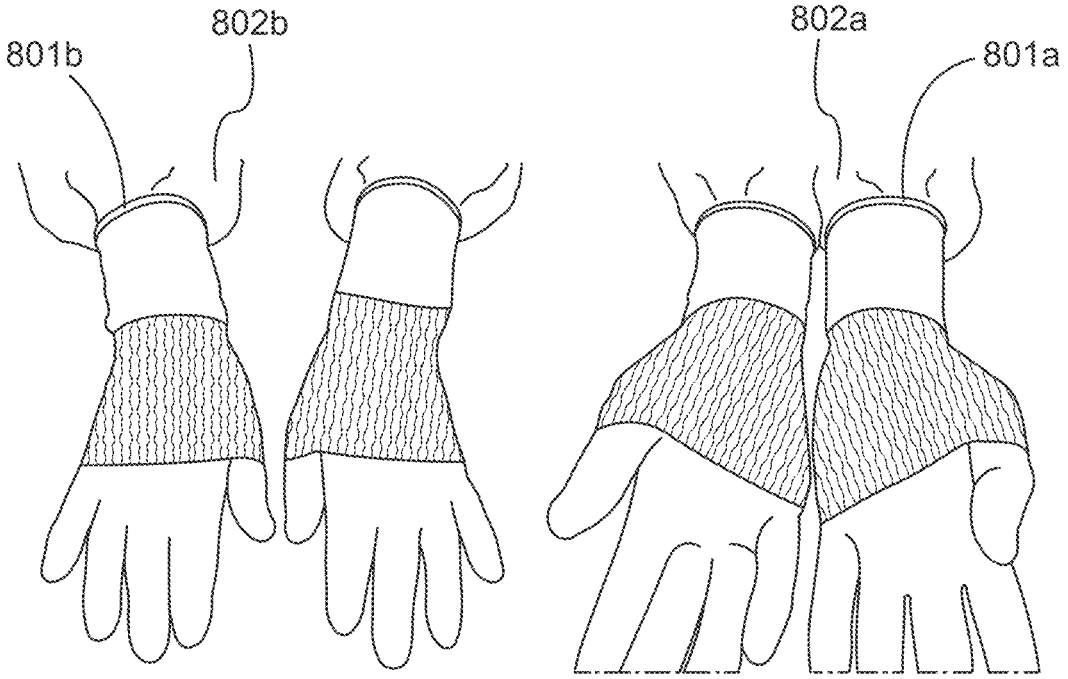
FIG. 8B shows two inventive sleeves as described in Example IV.
Figure 9:
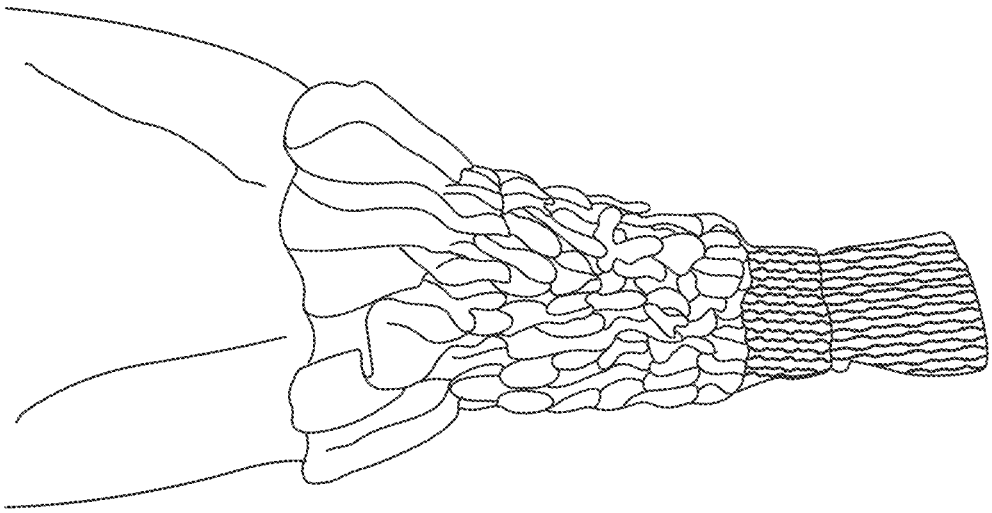
FIG. 9 shows an example barrier sleeve according to aspects of the present disclosure.
Figure 10:
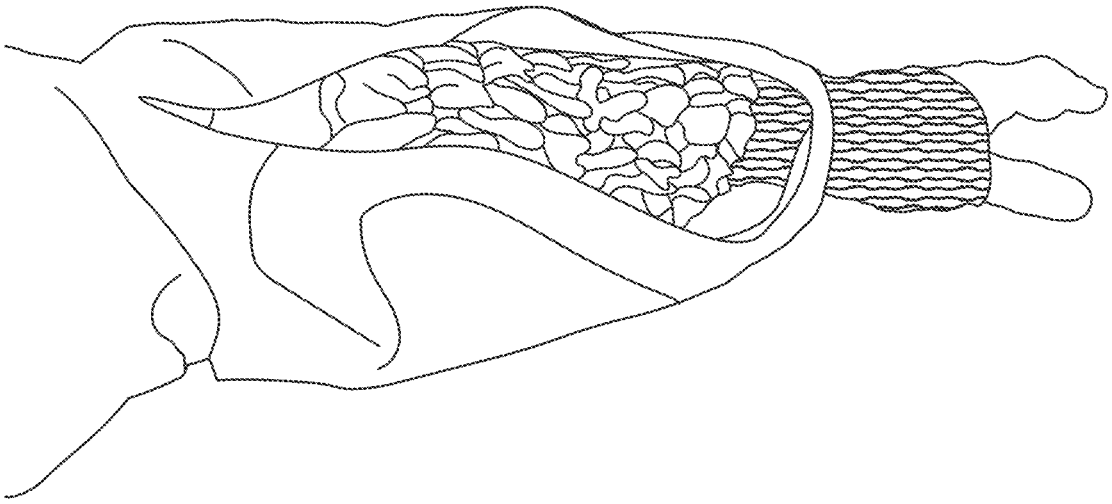
FIG. 10 shows a cutaway view of an example system according to aspects of the present disclosure.
Figure 11:
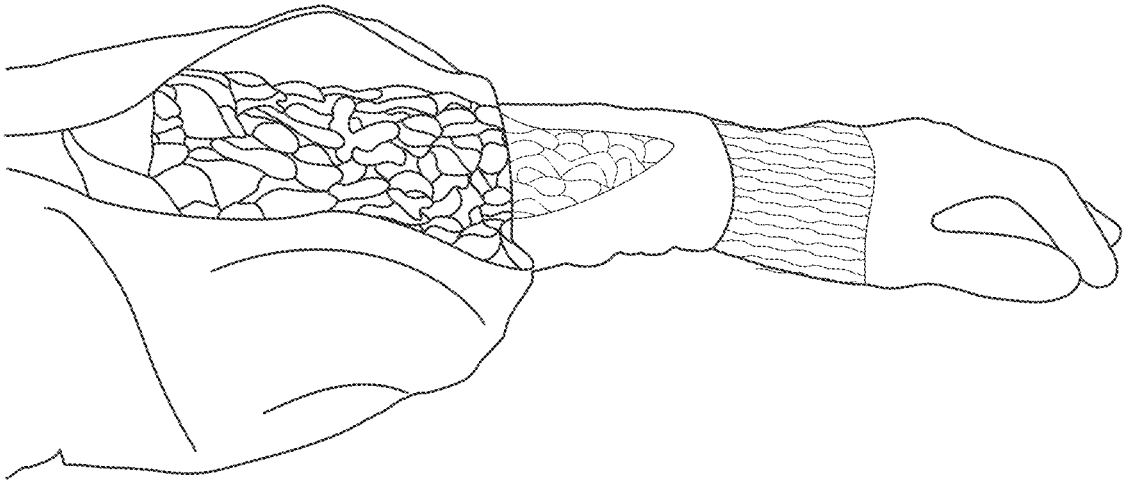
FIG. 11 shows a cutaway view of an example system according to aspects of the present disclosure.

FIGS. 8A and 8B shows the results of the wear study. In particular, FIG. 8A shows a sketch of a photograph of two control sleeves after two hours of wear. FIG. 8B shows a sketch of a photograph of two inventive sleeves after two hours of wear. As shown in FIG. 8B, the bead of the medical gloves 801*a*, 801*b* created channels in the gathered gasket material attached to sleeves 802*a*, 802*b* by compression of the gasket material sufficient to reduce roll-down of beads 802*a*, 802*b* as described herein. It was determined that the inventive sleeves showed a 40% greater average distance, a mean difference that is statistically significant. In addition, the inventive sleeves shows a 26% lower standard deviation compared to the control sleeves, indicating that across participants, the inventive sleeves provide less variation in distance after wear.

What is claimed is:

1. A barrier sleeve usable with a protective gown, the barrier sleeve comprising:

a tubular cuff section comprising a cuff material and having a cuff section first end and a cuff section second end; and a tubular gasket section comprising a gasket material, wherein the gasket section has a gasket section first end at the cuff section second end and a gasket section second end, wherein the gasket material comprises a gathered material and/or an extensible material, wherein the gasket material has a first thickness of at least 4.5 mm and is configured to exhibit a change in thickness upon compression of at least about 40%, and wherein the barrier sleeve meets requirements for viral penetration as specified by ASTM F1671.

2. The barrier sleeve of claim 1, further comprising a funnel section having a funnel section first end at the gasket section second end and a funnel section second end.

3. A system comprising a protective gown and a barrier sleeve, wherein the barrier sleeve comprises:

a tubular cuff section comprising a cuff material and having a cuff section first end and a cuff section second end, a tubular gasket section comprising a gasket material, and a funnel section having a funnel section first end at the gasket section second end and a funnel section second end, wherein the gasket section has a gasket section first end at the cuff section second end and a gasket section second end, wherein the gasket material comprises a gathered material and/or an extensible material, wherein the gasket material has a first thickness of at least 4.5 mm and is configured to exhibit a change in thickness upon compression of at least about 40%, wherein the funnel section second end is connected to an inner surface of a sleeve portion of the protective gown, and wherein the barrier sleeve meets requirements for viral penetration as specified by ASTM F1671.

4. The system of claim 3, wherein the funnel section second end is thermally bonded to the inner surface.

5. The barrier sleeve of claim 1, wherein the cuff material has a second thickness that is less than the first thickness.

6. The barrier sleeve of claim 1, wherein the gasket material comprises at least two layers of a nonwoven material having one or more elastic strands therebetween.

7. The barrier sleeve of claim 6, wherein the nonwoven material comprises an SMS laminate material and/or a spunbound material.

8. The barrier sleeve of claim 6, wherein the one or more elastic strands have a linear mass of at least 600 dtex.

9. The barrier sleeve of claim 1, wherein the gasket section first end is attached to the cuff section second end via an adhesive, stitching, ultrasonic bonding, tape, sealing, or a combination thereof.

10. The barrier sleeve of claim 1, wherein the first thickness is at least about 7 mm.

11. A system comprising:

a protective gown having a body portion and a first sleeve portion; and a barrier sleeve attached to an inner surface of the first sleeve portion, wherein the barrier sleeve comprises:

a tubular cuff section comprising a cuff material and having a cuff section first end and a cuff section second end, wherein the tubular cuff section is attached to the inner surface of the first sleeve portion between the cuff section first end and the cuff section second end such that the cuff section first end extends past an edge of the first sleeve portion; and a tubular gasket section comprising a gasket material, wherein the gasket section has a gasket section first end at the cuff section second end and a gasket section second end, wherein the gasket material comprises a gathered material and/or an extensible material, wherein the gasket material has a first thickness and is configured to exhibit a change in thickness upon compression of at least about 40%, and wherein the gasket section is not directly attached to the first sleeve portion.

12. The system according to claim 11, further comprising a funnel section having a funnel section first end at the gasket section second end and a funnel section second end attached to the inner surface of the first sleeve portion.

13. The system according to claim 11, wherein the first thickness is at least about 4.5 mm.

14. The system according to claim 11, wherein the gasket material comprises at least two layers of a nonwoven material having one or more elastic strands therebetween.

15. The system according to claim 11, wherein the first sleeve portion and the second sleeve portion are free of flaps and tabs.

16. A system comprising:

a protective gown having a body portion, a first sleeve portion, and a second sleeve portion; and a barrier sleeve attached to an inner surface of the first sleeve portion, wherein the barrier sleeve comprises a tubular cuff section having a cuff section first end and a cuff section second end, wherein the tubular cuff section is attached to the inner surface of the first sleeve portion between the cuff section first end and the cuff section second end such that the cuff section first end extends past an edge of the first sleeve portion, wherein the tubular cuff section comprises a cuff material comprising at least two layers of a nonwoven material having one or more elastic strands therebetween.

* * * * *